US008584272B2

(12) United States Patent
Ball

(10) Patent No.: US 8,584,272 B2
(45) **Date of Patent: *Nov. 19, 2013**

(54) METHOD AND ASSOCIATED APPARATUS FOR ASSEMBLING AND TESTING A PLUMBING SYSTEM

(71) Applicant: WCM Industries, Inc., Colorado Springs, CO (US)

(72) Inventor: William T. Ball, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/691,405

(22) Filed: Nov. 30, 2012

(65) Prior Publication Data

US 2013/0191988 A1 Aug. 1, 2013

Related U.S. Application Data

(63) Continuation of application No. 13/234,030, filed on Sep. 15, 2011, now Pat. No. 8,321,970, which is a (Continued)

(51) Int. Cl.
*E03C 1/22* (2006.01)
*E03C 1/24* (2006.01)

(52) U.S. Cl.
USPC ..... 4/680; 4/683; 4/688

(58) Field of Classification Search
USPC ..... 4/584, 680, 683, 688
See application file for complete search history.

(56) References Cited

U.S. PATENT DOCUMENTS 427,478 A 5/1890 McEvoy
437,289 A 9/1890 Clark (Continued)

FOREIGN PATENT DOCUMENTS

CH 346187 6/1960
DE 1163257 2/1954

(Continued)

OTHER PUBLICATIONS

Complaint (with Exhibits A-J), *WCM Industries, Inc.* v. *IPS Corporation, et al.*, U.S. District Court, Western District of Tennessee, Western Division, Case No. 2:13-cv-02019-JPM-tmp, filed Jan. 9, 2013, 117 pages.

(Continued)

*Primary Examiner* — Brian Glessner
*Assistant Examiner* — Brian D Mattei
(74) *Attorney, Agent, or Firm* — Sheridan Ross P.C.

(57) ABSTRACT

A system is provided for enhancing the interconnectability of a bathtub to a plumbing system. More specifically, provided is a flexible conduit and an overflow assembly that allows for a portion of the overflow assembly to be easily located with the wall of a bathtub. The flexible conduit provided allows for adjustability of the conduit to the openings of the bathtub. In addition, provided are methods and apparatus that facilitate testing of a plumbing assembly. Finally, an apparatus and methods are provided that protect portions of the finished bathtub assembly to decrease in the need for replacing said hardware. It is envisioned that aspects and inventions disclosed herein can be used in conjunction to facilitate the interconnection and protection of hardware associated with a bathtub.

13 Claims, 23 Drawing Sheets

Related U.S. Application Data continuation of application No. 11/931,681, filed on Oct. 31, 2007, now Pat. No. 8,028,357, which is a continuation-in-part of application No. 10/674,862, filed on Sep. 30, 2003, now abandoned, which is a continuation-in-part of application No. 10/222,062, filed on Aug. 16, 2002, now Pat. No. 6,637,050, and a continuation-in-part of application No. 10/229,533, filed on Aug. 28, 2002, now Pat. No. 6,675,406, which is a continuation of application No. 09/593,724, filed on Jun. 13, 2000, now abandoned, application No. 13/691,405, which is a continuation-in-part of application No. 10/732,726, filed on Dec. 10, 2003, now Pat. No. 8,302,220, which is a continuation-in-part of application No. 09/954,420, filed on Sep. 17, 2001, now Pat. No. 6,691,411, application No. 13/691,405, which is a continuation-in-part of application No. 10/721,694, filed on Nov. 25, 2003, now abandoned, which is a continuation-in-part of application No. 10/247,247, filed on Sep. 19, 2002, now abandoned, application No. 13/691,405, which is a continuation-in-part of application No. 10/971,895, filed on Oct. 22, 2004, now abandoned, and a continuation-in-part of application No. 11/161,933, filed on Aug. 23, 2005, now Pat. No. 7,503,083.

(56) References Cited

U.S. PATENT DOCUMENTS

| | | | |
|---|---|---|---|
| 608,207 | A | 8/1898 | Merrltt |
| 775,020 | A | 11/1904 | Waterman |
| 820,437 | A | 5/1906 | Pehrson |
| 843,968 | A | 2/1907 | Sharp, Jr. |
| 917,717 | A | 4/1909 | Diedrlck |
| 952,240 | A | 3/1910 | Deming |
| 964,954 | A | 7/1910 | Coles |
| 1,013,175 | A | 1/1912 | Jones |
| 1,018,021 | A | 2/1912 | Willetts |
| 1,068,039 | A | 7/1913 | Clark |
| 1,173,710 | A | 2/1916 | Crocker et al. |
| 1,173,854 | A | 2/1916 | Pearch |
| 1,213,466 | A | 1/1917 | Delanoy et al. |
| 1,330,909 | A | 2/1920 | Sharp, Jr. |
| 1,518,599 | A | 12/1924 | Murray |
| 1,528,081 | A | 3/1925 | Schermerhorn et al. |
| 1,573,820 | A | 2/1926 | Gade |
| 1,669,473 | A | 5/1928 | Kelso |
| 1,692,710 | A | 11/1928 | Spahn |
| 1,760,704 | A | 5/1930 | Lindstrom |
| 1,781,719 | A | 11/1930 | Henry |
| 1,788,083 | A | 1/1931 | Church |
| 1,873,274 | A | 8/1932 | Boosey |
| 1,893,979 | A | 1/1933 | Barrere |
| 1,925,008 | A | 8/1933 | Schacht |
| 1,977,177 | A | 10/1934 | De Flores |
| 1,980,493 | A | 11/1934 | Morrisseau |
| 2,016,498 | A | 10/1935 | Hopewell |
| 2,036,614 | A | 4/1936 | Tharp |
| 2,044,253 | A | 6/1936 | Morris |
| 2,045,731 | A | 6/1936 | Solari |
| 2,045,732 | A | 6/1936 | Solari |
| 2,059,532 | A | 11/1936 | Nagel |
| 2,061,553 | A | 11/1936 | Acosta |
| 2,062,145 | A | 11/1936 | Pickop |
| 2,084,437 | A | 6/1937 | Frankenberger |
| 2,197,716 | A | 4/1940 | Whltaker |
| 2,223,365 | A | 12/1940 | Groeniger |
| 2,374,815 | A | 5/1945 | Haas, Jr. |
| 2,444,340 | A | 6/1948 | Donahue |
| 2,462,752 | A | 2/1949 | Kotches |
| 2,570,546 | A | 10/1951 | Hamlett |
| 2,580,575 | A | 1/1952 | Muckler |
| 2,832,081 | A | 4/1958 | Young |
| 2,915,903 | A | 12/1959 | Digby et al. |
| 2,966,311 | A | 12/1960 | Davis |
| 2,992,437 | A | 7/1961 | Nelson et al. |
| 2,993,655 | A | 7/1961 | O'Brien |
| RE25,175 | E | 5/1962 | Nelson et al. |
| 3,096,527 | A | 7/1963 | Eynon |
| 3,121,879 | A | 2/1964 | Young |
| 3,263,244 | A | 8/1966 | Katz |
| 3,345,085 | A | 10/1967 | Hanes |
| 3,380,081 | A | 4/1968 | Eilertson et al. |
| 3,416,982 | A | 12/1968 | Petzetakis |
| 3,493,978 | A | 2/1970 | Hindman et al. |
| 3,608,098 | A | 9/1971 | Andrisani |
| 3,615,984 | A | 10/1971 | Chase |
| 3,724,507 | A | 4/1973 | Kleykamp et al. |
| 3,860,977 | A | 1/1975 | Poltz |
| 3,937,497 | A | 2/1976 | Studer |
| D248,133 | S | 6/1978 | Shames et al. |
| 4,135,258 | A | 1/1979 | Braga et al. |
| 4,146,939 | A | 4/1979 | Izzi |
| 4,194,251 | A | 3/1980 | Pennerstorfer |
| 4,233,697 | A | 11/1980 | Cornwall |
| 4,238,860 | A | 12/1980 | Dixon |
| 4,240,166 | A | 12/1980 | Altman et al. |
| 4,294,370 | A | 10/1981 | Toeppen |
| 4,307,901 | A | 12/1981 | Orberg et al. |
| 4,310,933 | A | 1/1982 | Stratman |
| 4,352,213 | A | 10/1982 | Watts |
| 4,359,790 | A | 11/1982 | Chalberg |
| 4,371,991 | A | 2/1983 | Schrott |
| 4,387,914 | A | 6/1983 | Paulson et al. |
| 4,413,384 | A | 11/1983 | Lassche |
| 4,470,437 | A | 9/1984 | Rabinovich |
| 4,542,642 | A | 9/1985 | Tagliarino |
| 4,553,625 | A | 11/1985 | Tsuge et al. |
| 4,594,738 | A | 6/1986 | Gebert |
| 4,599,784 | A | 7/1986 | Canu, Jr. et al. |
| 4,683,597 | A | 8/1987 | Taylor et al. |
| 4,720,877 | A | 1/1988 | Watts |
| 4,722,556 | A | 2/1988 | Todd |
| 4,730,855 | A | 3/1988 | Pelletier |
| D296,816 | S | 7/1988 | Budzinski et al. |
| 4,763,510 | A | 8/1988 | Palmer |
| 4,796,926 | A | 1/1989 | Rapsilver |
| 4,813,745 | A | 3/1989 | Woody |
| 4,825,477 | A | 5/1989 | Aranda |
| 4,865,353 | A | 9/1989 | Osborne |
| 4,890,967 | A | 1/1990 | Rosenbaum |
| 4,920,582 | A | 5/1990 | Alker |
| 4,936,350 | A | 6/1990 | Huber |
| 4,953,235 | A | 9/1990 | Cornwall |
| 5,025,509 | A | 6/1991 | Holt et al. |
| 5,076,095 | A | 12/1991 | Erhardt |
| 5,115,554 | A | 5/1992 | Fell, Sr. |
| 5,163,480 | A | 11/1992 | Huber |
| D341,410 | S | 11/1993 | Molinaro |
| 5,257,648 | A | 11/1993 | Oropallo |
| 5,265,281 | A | 11/1993 | McAlpine |
| 5,267,474 | A | 12/1993 | Ten Hoven |
| 5,273,077 | A | 12/1993 | Oropallo |
| 5,318,230 | A | 6/1994 | Ferguson et al. |
| 5,324,001 | A | 6/1994 | Duke |
| 5,330,811 | A | 7/1994 | Buchalter |
| 5,350,266 | A | 9/1994 | Espey et al. |
| 5,351,996 | A | 10/1994 | Martin |
| 5,363,519 | A | 11/1994 | Husting |
| 5,377,361 | A | 1/1995 | Piskula |
| 5,417,460 | A | 5/1995 | Lunder |
| 5,418,983 | A | 5/1995 | Garguillo et al. |
| 5,495,750 | A | 3/1996 | Dufresne |
| 5,497,514 | A | 3/1996 | Miller |
| 5,497,516 | A | 3/1996 | Irwin |
| 5,507,501 | A | 4/1996 | Palmer |
| 5,509,148 | A | 4/1996 | Steele et al. |
| 5,535,455 | A | 7/1996 | Liu |
| D373,623 | S | 9/1996 | Mathison |
| 5,560,052 | A | 10/1996 | Ferguson et al. |
| 5,581,018 | A | 12/1996 | Allen et al. |
| 5,590,916 | A | 1/1997 | Liu |

(56) References Cited

U.S. PATENT DOCUMENTS

| | | | |
|---|---|---|---|
| D381,405 | S | 7/1997 | Waidele et al. |
| 5,661,462 | A | 8/1997 | Shrewsbury-Gee |
| 5,682,620 | A | 11/1997 | Stoltz et al. |
| 5,692,248 | A | 12/1997 | Ball |
| 5,740,830 | A | 4/1998 | Mankins |
| 5,745,931 | A | 5/1998 | Ball |
| 5,758,368 | A | 6/1998 | Ball |
| 5,786,054 | A | 7/1998 | Platusich et al. |
| 5,799,986 | A | 9/1998 | Corbett et al. |
| 5,815,895 | A | 10/1998 | Carlson et al. |
| 5,890,241 | A | 4/1999 | Ball |
| 5,931,184 | A | 8/1999 | Armenia et al. |
| 5,944,985 | A | 8/1999 | Bowman |
| 5,957,514 | A | 9/1999 | Brookshire |
| 5,971,438 | A | 10/1999 | Johnson |
| 5,997,049 | A | 12/1999 | Kingsford et al. |
| 6,058,525 | A | 5/2000 | Paden |
| 6,058,526 | A | 5/2000 | Parisi et al. |
| 6,062,254 | A | 5/2000 | Brady et al. |
| 6,066,119 | A | 5/2000 | Ball |
| 6,073,278 | A | 6/2000 | Ball |
| 6,076,545 | A | 6/2000 | Cooper |
| D428,133 | S | 7/2000 | Chen |
| 6,085,363 | A | 7/2000 | Huber |
| 6,088,843 | A | 7/2000 | Francisco |
| 6,098,212 | A | 8/2000 | Rogan |
| 6,126,233 | A | 10/2000 | Gaetano et al. |
| 6,145,136 | A | 11/2000 | Parisi et al. |
| 6,173,459 | B1 | 1/2001 | Ball |
| 6,185,755 | B1 | 2/2001 | Shepherd et al. |
| 6,192,531 | B1 | 2/2001 | Fritz et al. |
| 6,193,879 | B1 | 2/2001 | Bowman |
| 6,205,594 | B1 | 3/2001 | Solaberry |
| 6,216,288 | B1 | 4/2001 | Bernau |
| 6,263,518 | B1 | 7/2001 | Magtanong |
| 6,272,699 | B1 | 8/2001 | Peterson |
| 6,289,532 | B1 | 9/2001 | Fritz et al. |
| 6,295,659 | B1 | 10/2001 | Sandness |
| 6,295,664 | B2 | 10/2001 | Fritz et al. |
| 6,317,906 | B1 | 11/2001 | Ball |
| 6,338,168 | B1 | 1/2002 | Valentine |
| 6,362,734 | B1 | 3/2002 | McQuade et al. |
| 6,378,912 | B1 | 4/2002 | Condon et al. |
| 6,418,570 | B1 | 7/2002 | Ball |
| 6,448,907 | B1 | 9/2002 | Naclerio |
| 6,484,331 | B2 | 11/2002 | Minnick |
| 6,510,860 | B2 | 1/2003 | Kihs |
| 6,530,722 | B1 | 3/2003 | Shaw et al. |
| 6,546,573 | B1 | 4/2003 | Ball |
| 6,592,669 | B2 | 7/2003 | Damrau |
| 6,606,753 | B2 | 8/2003 | Minnick |
| 6,618,875 | B1 | 9/2003 | Oropallo et al. |
| 6,622,317 | B1 | 9/2003 | Oropallo et al. |
| 6,637,050 | B1 | 10/2003 | Ball |
| 6,640,358 | B2 | 11/2003 | Ball |
| 6,675,406 | B2 | 1/2004 | Ball |
| 6,681,420 | B1 | 1/2004 | Ball |
| 6,687,926 | B1 | 2/2004 | Bayley |
| 6,691,411 | B2 | 2/2004 | Ball |
| 6,696,943 | B1 | 2/2004 | Elrod et al. |
| 6,719,294 | B2 | 4/2004 | Nguyen et al. |
| 6,812,844 | B1 | 11/2004 | Burgess |
| 6,836,911 | B2 | 1/2005 | Minnick |
| 6,901,611 | B2 | 6/2005 | McEntire et al. |
| 6,953,049 | B2 | 10/2005 | Kowalke |
| D517,666 | S | 3/2006 | Wilk, Jr. et al. |
| 7,017,199 | B2 | 3/2006 | Oropallo et al. |
| D523,123 | S | 6/2006 | Wilk, Jr. et al. |
| 7,127,752 | B2 | 10/2006 | Ball |
| 7,185,529 | B2 | 3/2007 | Ball |
| 7,210,493 | B1 | 5/2007 | Wang |
| 7,237,280 | B1 | 7/2007 | Holden, Jr. et al. |
| 7,300,074 | B1 | 11/2007 | Paulson |
| 7,343,923 | B2 | 3/2008 | Foster |
| 7,451,502 | B2 | 11/2008 | Ball |
| D586,433 | S | 2/2009 | Price et al. |
| 7,503,083 | B2 | 3/2009 | Ball |
| 7,740,197 | B1 | 6/2010 | Schulz |
| D627,862 | S | 11/2010 | Ball |
| D627,863 | S | 11/2010 | Ball |
| D636,468 | S | 4/2011 | Ball |
| D637,696 | S | 5/2011 | Ball et al. |
| 8,028,357 | B2 | 10/2011 | Ball |
| 8,166,584 | B2 | 5/2012 | Ball |
| D665,062 | S | 8/2012 | Ball |
| 8,302,220 | B2 | 11/2012 | Ball |
| 8,321,970 | B2 | 12/2012 | Ball |
| D674,883 | S | 1/2013 | Ball |
| 2002/0032926 | A1 | 3/2002 | Lewis |
| 2002/0121982 | A1 | 9/2002 | Ferris et al. |
| 2003/0151281 | A1 | 8/2003 | Williams |
| 2004/0012197 | A1 | 1/2004 | Guillaud et al. |
| 2004/0034926 | A1 | 2/2004 | Ball |
| 2004/0055083 | A1 | 3/2004 | Ball |
| 2004/0055084 | A1 | 3/2004 | Ball |
| 2004/0068792 | A1 | 4/2004 | Ball |
| 2004/0068793 | A1 | 4/2004 | Ball |
| 2004/0103474 | A1 | 6/2004 | Ball |
| 2004/0111797 | A1 | 6/2004 | Ball |
| 2006/0085907 | A1 | 4/2006 | Ball |
| 2006/0096018 | A1 | 5/2006 | Ball |
| 2006/0096019 | A1 | 5/2006 | Ball |
| 2006/0218992 | A1 | 10/2006 | Ball |
| 2007/0007763 | A1 | 1/2007 | Deaton |
| 2008/0148477 | A1 | 6/2008 | Shafik |
| 2008/0155745 | A1 | 7/2008 | Burr |
| 2008/0196161 | A1 | 8/2008 | Ball |
| 2009/0172877 | A1 | 7/2009 | Ball |
| 2009/0173396 | A1 | 7/2009 | Spadavecchia |
| 2009/0250120 | A1 | 10/2009 | Robbins |
| 2009/0260154 | A1 | 10/2009 | Shoop et al. |
| 2009/0261579 | A1 | 10/2009 | Spears |
| 2010/0163131 | A1 | 7/2010 | Fehr et al. |
| 2011/0209279 | A1 | 9/2011 | Ball |
| 2011/0289667 | A1 | 12/2011 | Oropallo et al. |
| 2012/0005824 | A1 | 1/2012 | Ball |
| 2012/0090084 | A1 | 4/2012 | Ball |
| 2012/0246822 | A1 | 10/2012 | Ball |
| 2013/0055494 | A1 | 3/2013 | Ball |

FOREIGN PATENT DOCUMENTS

| | | |
|---|---|---|
| DE | 3138912 | 4/1983 |
| DE | 3603877 | 1/1997 |
| EP | 0845559 | 6/1998 |
| FR | 744099 | 4/1933 |
| FR | 1191141 | 10/1959 |
| FR | 2643097 | 8/1990 |
| GB | 1216208 | 12/1970 |
| GB | 2263060 | 7/1993 |
| JP | H02144074 | 12/1990 |
| WO | WO 99/54560 | 10/1999 |

OTHER PUBLICATIONS

Answer and Counterclaim, *WCM Industries, Inc.* v. *IPS Corporation, et al.*, U.S. District Court, Western District of Tennessee, Western Division, Case No. 2:13-cv-02019-JPM-tmp, filed Feb. 19, 2013, 16 pages.

Reply to Defendant'S Counterclaims, *WCM Industries, Inc.* v. *IPS Corporation, et al.*, U.S. District Court, Western District of Tennessee, Western Division, Case No. 2:13-cv-02019-JPM-tmp, filed Mar. 12, 2013, 4 pages.

Definition of the term "diaphragm" found at: http://www.thefreedictionary.com/diaphragm, Aug. 7, 2012 OA for U.S. Appl. No. 13/234,030.

"WCM Industries—Freezeless Faucets, Yard Hydrants and Bath Wastes", as early as Aug. 2000, available at http://www.woodfordmfg.com/, printed on Sep. 15, 2005, p. 1.

"New WATCO Eliminator Bath Waste", WATCO, as early as Aug. 8, 2001, pp. 1-2.

"Tubular Plastic-Innovator® 590", Woodford Manufacturing Company, first sold Aug. 16, 2001, pp. 1-2.

(56) References Cited

OTHER PUBLICATIONS

"Ultralite®—Type NM (Liquidtight Flexible Nonmetallic Conduit)", Southwire Company brochure/pamphlet, as early as 2003, printed on Dec. 14, 2008, pp. 1-3.
"PRESS-IN" Trim Kit, AB&A™ IPS Corporation (date unknown) 2 pages.
Notice of Allowance for Mexico Patent Application No. MX/a/2008/013956, dated Nov. 16, 2011.
Official Action for U.S. Appl. No. 11/931,681, mailed Apr. 26, 2011 15 pages.
Notice of Allowance for U.S. Appl. No. 11/931,681, mailed Aug. 4, 2011.
Official Action for U.S. Appl. No. 13/234,030, mailed Aug. 7, 2012 13 pages.
Notice of Allowance for U.S. Appl. No. 13/234,030, mailed Oct. 19, 2012 5 pages.
Official Action for U.S. Appl. No. 10/732,726, mailed Mar. 28, 2005.
Official Action for U.S. Appl. No. 10/732,726, mailed May 23, 2005.
Official Action for U.S. Appl. No. 10/732,726, mailed Oct. 24, 2005.
Official Action for U.S. Appl. No. 10/732,726, mailed May 19, 2006.
Official Action for U.S. Appl. No. 10/732,726, mailed Jan. 30, 2008.
Official Action for U.S. Appl. No. 10/732,726, mailed May 1, 2008.
Official Action for U.S. Appl. No. 10/732,726, mailed Jun. 2, 2008.
Official Action for U.S. Appl. No. 10/732,726, mailed Aug. 20, 2008.
Official Action for U.S. Appl. No. 10/732,726, mailed Nov. 17, 2008.
Office Action for U.S. Appl. No. 10/732,726, mailed Dec. 9, 2008.
Official Action for U.S. Appl. No. 10/732,726, mailed Sep. 4, 2009.
Official Action for U.S. Appl. No. 10/732,726, mailed Apr. 15, 2010.
Official Action for U.S. Appl. No. 10/732,726, mailed Oct. 25, 2010.
Official Action for U.S. Appl. No. 10/732,726, mailed May 9, 2011 9 pages.
Official Action for U.S. Appl. No. 10/732,726, mailed Nov. 16, 2011 9 pages.
Notice of Allowance for U.S. Appl. No. 10/732,726, mailed Sep. 20, 2012, 5 pages.
Official Action for U.S. Appl. No. 11/161,933, mailed Jun. 23, 2008.
Official Action for U.S. Appl. No. 12/405,956, mailed Oct. 14, 2010.
Notice of Allowance for U.S. Appl. No. 11/161,933, mailed Jan. 29, 2009.

METHOD AND ASSOCIATED APPARATUS FOR ASSEMBLING AND TESTING A PLUMBING SYSTEM

CROSS REFERENCE TO RELATED APPLICATIONS

This application is a Continuation of U.S. patent application Ser. No. 13/234,030, filed, Sep. 15, 2011, which is a Continuation of U.S. patent application Ser. No. 11/931,681, filed Oct. 31, 2007, now U.S. Pat. No. 8,028,357, which is a Continuation-In-Part of abandoned U.S. patent application Ser. No. 10/674,862, filed Sep. 30, 2003, which is a Continuation-In-Part of U.S. patent application Ser. No. 10/222,062, now U.S. Pat. No. 6,637,050, filed Aug. 16, 2003 and a Continuation-In-Part of U.S. patent application Ser. No. 10/229,533, now U.S. Pat. No. 6,675,406, filed Aug. 28, 2002, which is a Continuation of abandoned U.S. patent application Ser. No. 09/593,724, filed Jun. 13, 2000. This application is a Continuation-In-Part of U.S. patent application Ser. No. 10/732,726, filed Dec. 10, 2003, which is a Continuation-In-Part of U.S. patent application Ser. No. 09/954,420, now U.S. Pat. No. 6,691,411, filed Sep. 17, 2001. This application is a Continuation-In-Part of abandoned U.S. patent application Ser. No. 10/721,694, filed Nov. 25, 2003, which is a Continuation-In-Part of abandoned U.S. patent application Ser. No. 10/247,247, filed Sep. 19, 2002. This application is a Continuation-In-Part of abandoned U.S. patent application Ser. No. 10/971,895, filed Oct. 22, 2004. This application is a Continuation-In-Part of U.S. patent application Ser. No. 11/161,933, now U.S. Pat. No. 7,503, 083, filed Aug. 23, 2005. The entire disclosures of which are incorporated by reference herein.

This application is also related to U.S. patent application Ser. No. 11/873,200 filed Oct. 16, 2007, which is a Continuation-In-Part of U.S. patent application Ser. No. 11/423,996, filed Jun. 14, 2006, which is a Continuation of U.S. patent application Ser. No. 10/370,545, now U.S. Pat. No. 7,185, 529, filed Feb. 20, 2003. The entire disclosures of which are incorporated by reference herein.

FIELD OF THE INVENTION

Embodiments of the present invention are generally related to components of a plumbing system that is used in conjunction with a bathtub, shower stall, since, etc. More specifically, embodiments of the present invention relate to a kit that includes devices that facilitate interconnection of the plumbing system to the bathtub, that allows for testing of the interconnection, and protects finished hardware associated with the bathtub.

BACKGROUND OF THE INVENTION

During new building construction or renovation of an existing building structure, plumbers often must connect or reconnect bathroom fixtures to the plumbing system. Often plumbers find that interconnecting common bathroom fixtures, such as a bathtub, is difficult and time consuming. "Bathtubs" as referred to herein include a tub with a drain port and an overflow port such that if the drain port is plugged, water will flow into the overflow port and drain through the plumbing system and not out of the tub. Generally, the bathtub is interconnected to the plumbing system of a structure by a main drain pipe which associated to the drain port of the bathtub via a horizontal segment and which is associated with the overflow port of the bathtub via a vertical segment. These two drain segments merge at a tee connector that is also interconnected to the main drain pipe that feeds into a sewer line. During construction, the often heavy bathtub must be aligned properly to interconnect with the drain pipe segment (horizontal) and the overflow pipe segment (vertical) of the drain pipe. Often the drain pipe segments are near a wall, awkwardly oriented, etc. and are thus difficult to associate with the bathtub.

Once the drain pipe segments are aligned with the bathtub, the drain pipes must usually be blocked for testing. In the past, a plug, bladder or cap has been employed to facilitate testing. Plugs and/or caps are easily misplaced, and are often difficult to install, thereby increasing the time and difficulty of testing a plumbing system.

Another drawback of bathtub assemblies of the prior art is that the finishing hardware generally associated with a drain of a bathtub often becomes damaged during construction. Traditionally, finishing hardware is interconnected to the bathtub drain port during construction since a rigid interconnection between the drain pipe and the bathtub is required. Thereafter, workers may damage the often expensive chrome or brass hardware by marring, scratching, or even urinating on the same. Thereafter the plumbing contractor must replace the finished hardware and retest the integrity of the new connection, which adds expense.

Thus it is a long felt need in plumbing to provide a system that facilitates the interconnection of a bathtub to a plumbing system, enhances the testing of the system and protects expensive hardware after the assembly is complete.

SUMMARY OF THE INVENTION

Traditionally, an overflow system of a bathtub includes an overflow port that is interconnected to a vertical drain pipe via an elbow.

It is one aspect of the present invention to facilitate this interconnection by providing an elbow with a flange protruding therefrom. More specifically, embodiments of the present invention employ a flange that is spaced from an end of the elbow that will be associated with the bathtub. The end, thus, defines a shoulder that is adapted to receive a cylindrical adapter having an obstructed end that prevents the flow of fluid through the cylindrical fitting and elbow. In one embodiment, the cylindrical fitting includes exterior threads that receive a nut.

In operation, one end of the elbow is interconnected to the drain pipe and the other end, which is located adjacent to the flange, is placed within the perimeter of the overflow port such that the flange abuts an outer surface of the bathtub. The cylindrical fitting is then interconnected to the elbow which locates the other, closed end of the cylindrical fitting within the bathtub. The nut is used to sandwich the bathtub between the nut and the flange, thereby providing a generally rigid connection. Some embodiments of the present invention also employ a washer between the tub and the nut. The nut may also provide the ability to interconnect a decorative cap.

It is a related aspect of the present invention to selectively block fluid flow through the overflow assembly. More specifically, the closed portion of the cylindrical fitting acts as a plug to aid in testing of the plumbing system. After testing is complete the closed portion may be cut, or otherwise removed, to allow fluid flow through the overflow assembly. If additional testing is required traditional methods of plugging the overflow assembly may be employed, which will be described in further detail below.

It is another aspect of the invention to provide a method of installing a drain assembly that can be accomplished by a single individual. A related aspect of the invention is to provide a method of installing a bathtub drain assembly that allows for ease in field testing for leaks. Yet another aspect of embodiments of the present invention is to provide a method of installing the drain assembly that eliminates the need for the removal of a strainer body often associated with drain assemblies. In accordance with these and other aspects, one method includes inserting an L-shaped drain pipe having a threaded upper end and an annular flange covered by a membrane, through a drain port of the bathtub, such that the annular flange rests on a bottom surface of the bathtub. Next, a lock washer is threadingly engaged to the inner end of the drain pipe to the threaded portion. The other end of the L-shaped drain pipe is then connected to the drain system of the building. The assembly can then be tested for leaks. Once it is determined that no leaks are present, the membrane is removed from the flange on the upper end of the drain pipe. Finally, a finished cover is installed on the annular flange.

It is yet another aspect of the present invention to provide a bathtub drain pipe assembly that facilitates integration of the various drain pipes mentioned thus far to the bathtub. Embodiments of the present invention thus include a flexible hollow tube instead of rigid drain pipes that simplifies the installation of the bathtub to the plumbing system. The flexible tube of embodiments of the present invention has the added benefit of being easily modifiable and possesses a smooth inner surface to prevent the often unsanitary trapping of fluid with the flexible hollow tube.

It is still yet another aspect of the present invention to provide a protective cover that interconnects to the installed drain assembly. More specifically, a flange of the protective drain cover is superimposed over the flange of a waste water strainer located in a bathtub, sink or the like. A lip located about the outer perimeter of the flange of the cover fits over the outer periphery of the flange of the waste water strainer and centers the cover on the strainer. A cylindrical wall, which extends from the flange of the cover, is positioned downwardly through a cylindrical wall of the waste water strainer. The two cylindrical walls are spaced from each other by one or more seals that are positioned in grooves.

It is an aspect of the embodiment of the present invention to combine some or all of the above-described aspects to provide a system that facilitates interconnection of the bathtub to the plumbing system of a structure. More specifically, it is contemplated to use aspects described above, provided below, or apparent to one skilled in the art in conjunction to alleviate all of the difficulties noted above that are associated with interconnecting a bathtub to a plumbing system of a structure. For example, one skilled in the art will appreciate the overflow assembly can be easily integrated with the flexible pipes described above to expand the interconnection options available to a plumber. In addition, the protective drain cover may also be used. It is contemplated that the above described aspects of the present invention will provide a complete kit wherein all of the necessary components will be included to aid the plumber in interconnecting a bathtub to the plumbing of a structure, facilitate testing of the same and protecting fragile and expensive components thereof, which will increase efficiency and decreasing costs of the operation.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
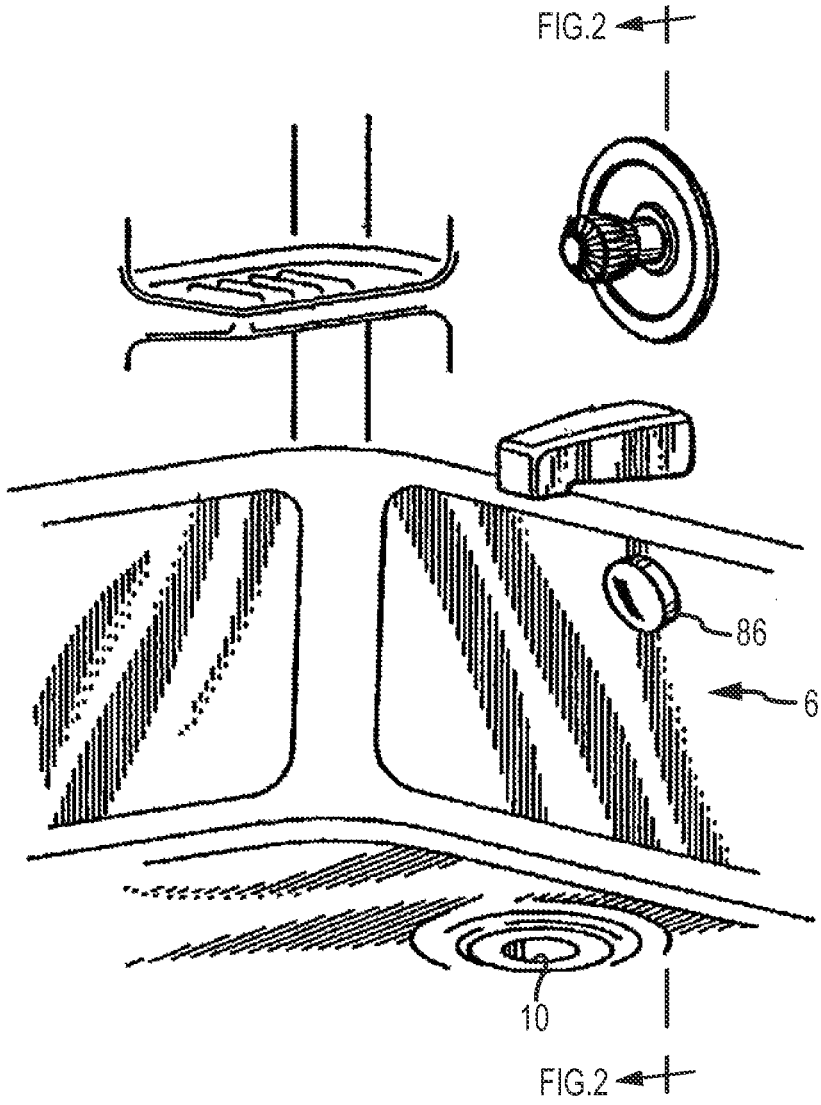
FIG. 1 is a partial perspective view of a bathtub.

To assist in the understanding of the present invention the following list of components and associated numbering found in the drawings is provided herein:

| # | Component |
|---|---|
| 2 | Overflow assembly |
| 6 | Bathtub |
| 10 | Drain port |
| 14 | Overflow port |
| 18 | Elbow |
| 22 | Overflow pipe |
| 26 | Tee connector |
| 30 | First end |
| 34 | Second end |
| 38 | Flange |
| 42 | Shoulder |
| 46 | Cylindrical fitting |
| 50 | Threads |
| 54 | Diaphragm |
| 58 | Outer surface |
| 62 | Wall |
| 66 | Inner surface |
| 70 | Washer |
| 74 | Nut |
| 78 | Lug |
| 82 | Threads |
| 86 | Cap |
| 90 | Notch |
| 94 | Protrusions |
| 98 | Ring |
| 102 | Cutting tool |
| 106 | Opening |
| 110 | Drain assembly |
| 112 | Edge |
| 114 | Tub floor |
| 118 | Drain pipe flange |
| 122 | Nut |
| 126 | Cylindrical portion |
| 130 | Threads |
| 134 | Drain pipe |
| 138 | Membrane |
| 140 | Cover |
| 144 | Drain closure |
| 176 | Test cap |
| 180 | Cylindrical body |
| 184 | Flange |
| 188 | Face |
| 192 | Interior threads |
| 196 | Inner surface |
| 200 | Protective cover |
| 204 | Opening |
| 208 | Flange |
| 212 | Tubular wall |
| 216 | Groove |
| 220 | Seal |
| 224 | Strainer |
| 228 | First portion |
| 232 | Second portion |
| 236 | Conical portion |

It should be understood that the drawings are not necessarily to scale. In certain instances, details which are not necessary for an understanding of the invention or which render other details difficult to perceive may have been omitted. It should be understood, of course, that the invention is not necessarily limited to the particular embodiments illustrated herein.

DETAILED DESCRIPTION

Referring now to FIGS. 1-9 an overflow assembly 2 adapted for interconnection to a bathtub 6 is provided. The overflow assembly 2 is adapted to be used in conjunction with a bathtub 6 having a drain port 10 and an overflow port 14. The overflow port 14 receives an L shaped elbow 18 that leads into an overflow pipe 22 that eventually feeds into a tee-connector 26. The tee-connector 26 also receives fluid from the drain port 10 of the bathtub 6 and has an opening that connects to the sewer system of the structure.

Figure 2:
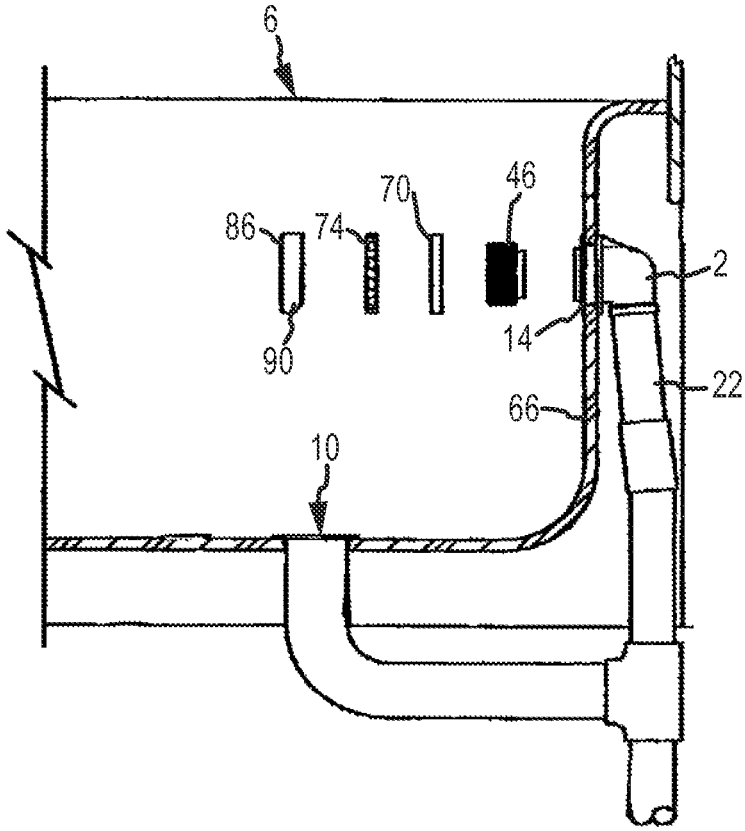
FIG. 2 is a cross-sectional view of FIG. 1.
Figure 3:
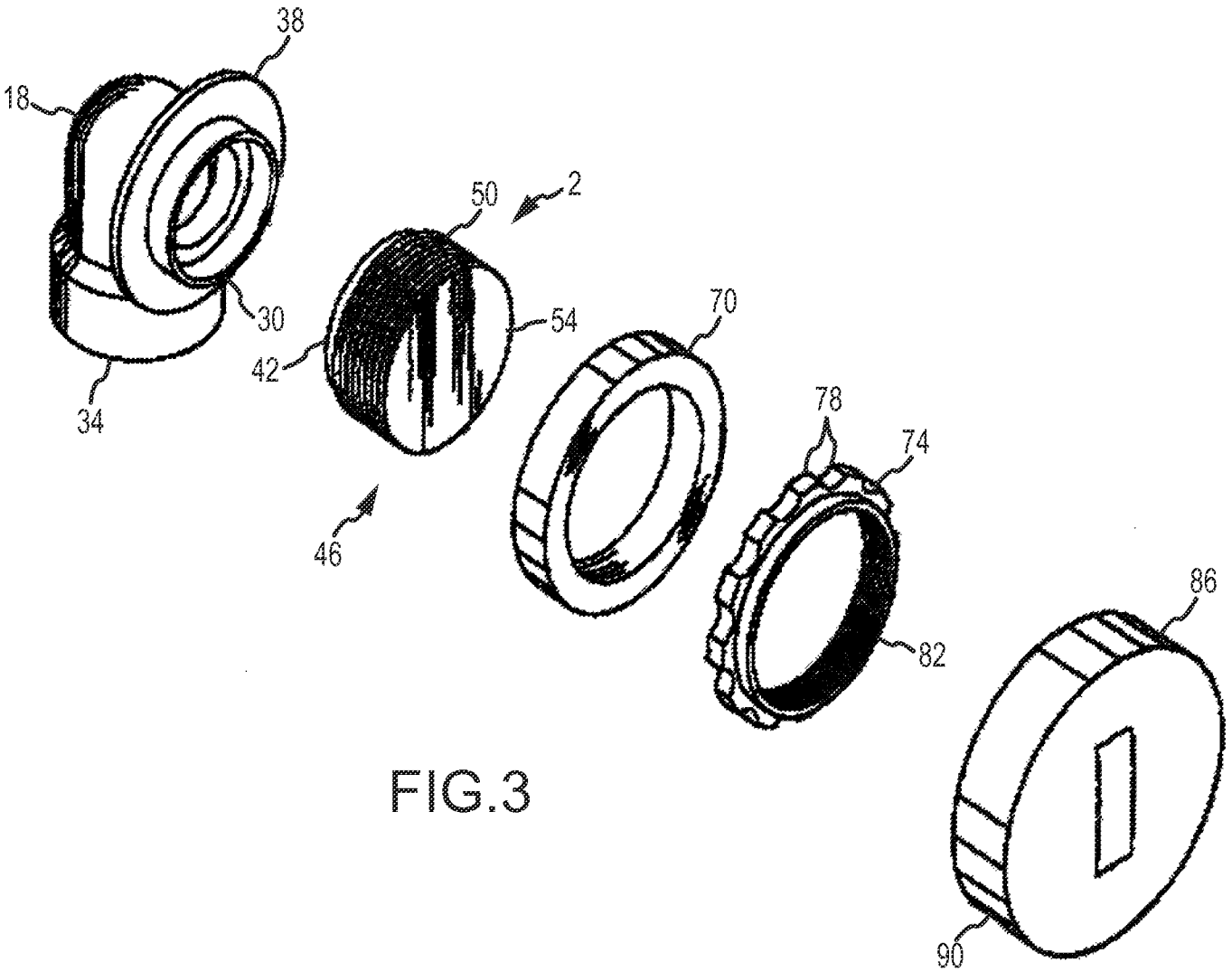
FIG. 3 is an exploded perspective view of an overflow assembly of one embodiment of the present invention.
Figure 4:
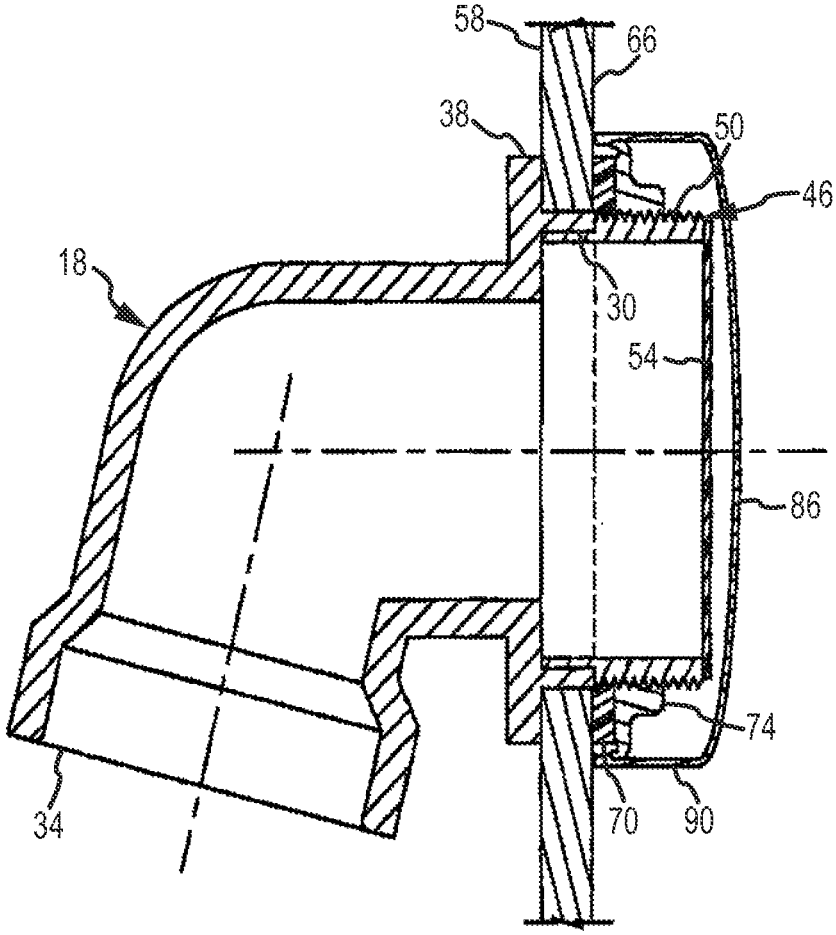
FIG. 4 is a cross-sectional assembled view of the overflow assembly shown in FIG. 3.

Turning now specifically to FIGS. 2-4, an overflow assembly of one embodiment of the present invention is provided. Here, the elbow 18 includes a first end 30 and a second end 34 wherein a flange 38 is spaced from the first end 30. Thus, the first end 30 comprises a lip that protrudes from the flange 38. The first end 30 is adapted to receive a shoulder 42 of a cylindrical fitting 46 that also includes an outer surface with a plurality of threads 50 and may have a diaphragm 54 situated on one end thereof.

In operation, the flange 38 is adapted to abut an outer surface 58 of the bathtub 6, thereby placing the first end 30 at least partially within the thickness of the bathtub wall 62 or away from an inner surface 66 of the bathtub 6 which facilitates alignment of the overflow port and the overflow assembly 2. After the elbow 18 is properly aligned and engaged within the overflow port 14 of the bathtub 6, the cylindrical fitting 46 is interconnected thereto wherein the shoulder 42 is placed in contact with the first end 30 of the elbow 18. A washer 70 is then placed around the cylindrical fitting 46 and in abutting relationship with the inner surface 66 of the bathtub 6. A nut 74 having a plurality of externally protruding lugs 78 and internal threads 82 is then screwed on to the threads 50 of the cylindrical fitting 46, thereby sandwiching the wall 62 of the bathtub 6 between the flange 38 and the washer 70. The lugs 78 of the nut 74 are adapted to receive an inner surface of a cap 86. The cap 86 also employs at least one notch 90 that allows for water to flow from the cap 86 through the elbow 18 and into the overflow pipe 22 of the plumbing system.

After the overflow system is interconnected to the bathtub, testing it is often required. Often such testing of the overflow assembly 2 must be blocked. Thus, as briefly described above, the cylindrical fitting 46 may include a diaphragm 54 that prevents flow of liquid therethrough. After testing is complete the diaphragm 54 may be cut away to provide a flow path from the notch 90 of the cap 86 into the elbow 18. No additional hardware, such as a test cap, is needed to perform testing.

Figure 5:
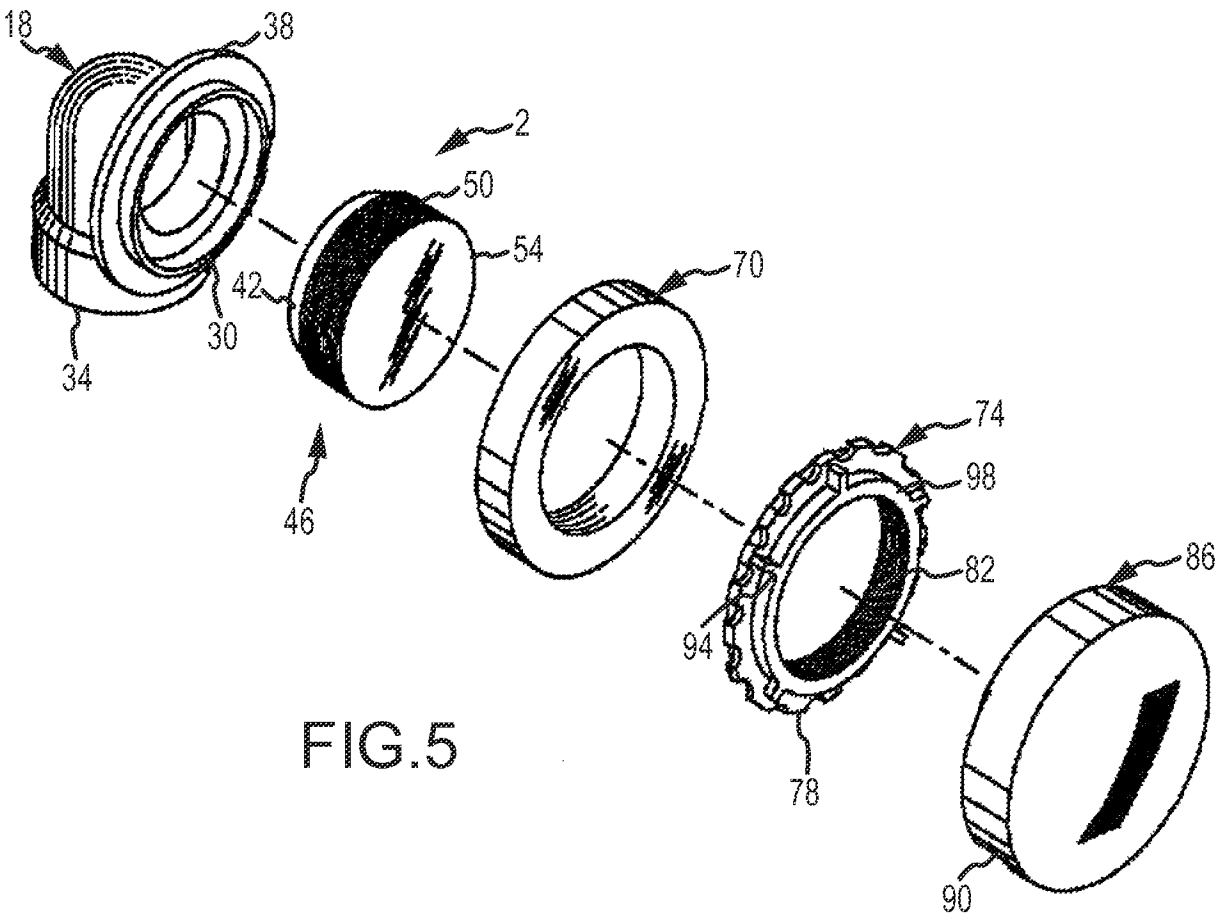
FIG. 5 is an exploded perspective view of an alternate embodiment of an overflow assembly.
Figure 6:
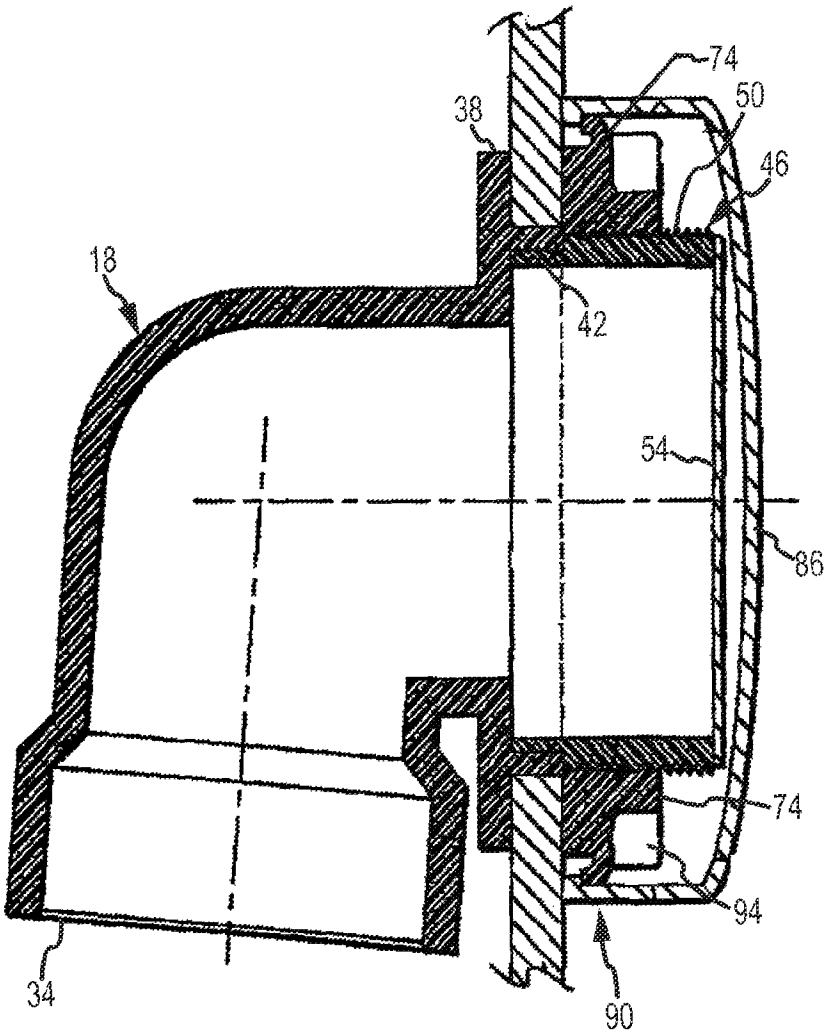
FIG. 6 is a cross-sectional, assembled view of the overflow assembly shown in FIG. 5.

Referring now to FIGS. 5 and 6, an alternate embodiment of an overflow assembly 2 is provided. More specifically, the nut 74 described above includes a plurality of protrusions 94 aligned on a ring 98 that is positioned adjacent to the plurality of the lugs 78. The protrusions 94 allow for enhanced interconnectability between the nut 74 and the cylindrical fitting 46 by providing a plurality of finger holds.

Figure 7:
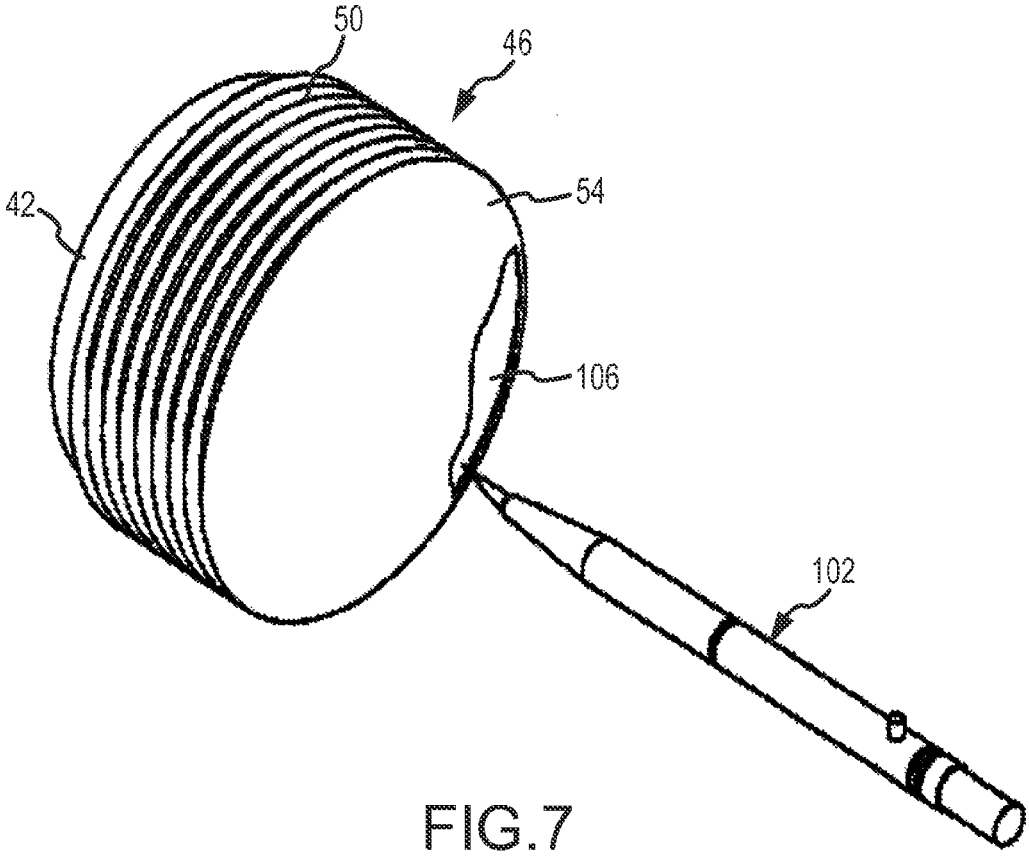
FIG. 7 is a perspective view of a cylindrical fitting employed in overflow assemblies of some embodiments of the present invention.

Referring now to FIG. 7, the cylindrical fitting 46 of the overflow assembly 2 of one embodiment of the present invention is provided. As mentioned above, it is often desirous to maintain the integrity of the overflow assembly 2 such that fluids or air are maintained within the plumbing assembly, i.e. plugged. After any required testing is complete, a cutting tool 102 is employed to remove the diaphragm 54 of the cylindrical fitting 46, thereby providing an opening 106 for fluids.

Figure 8:
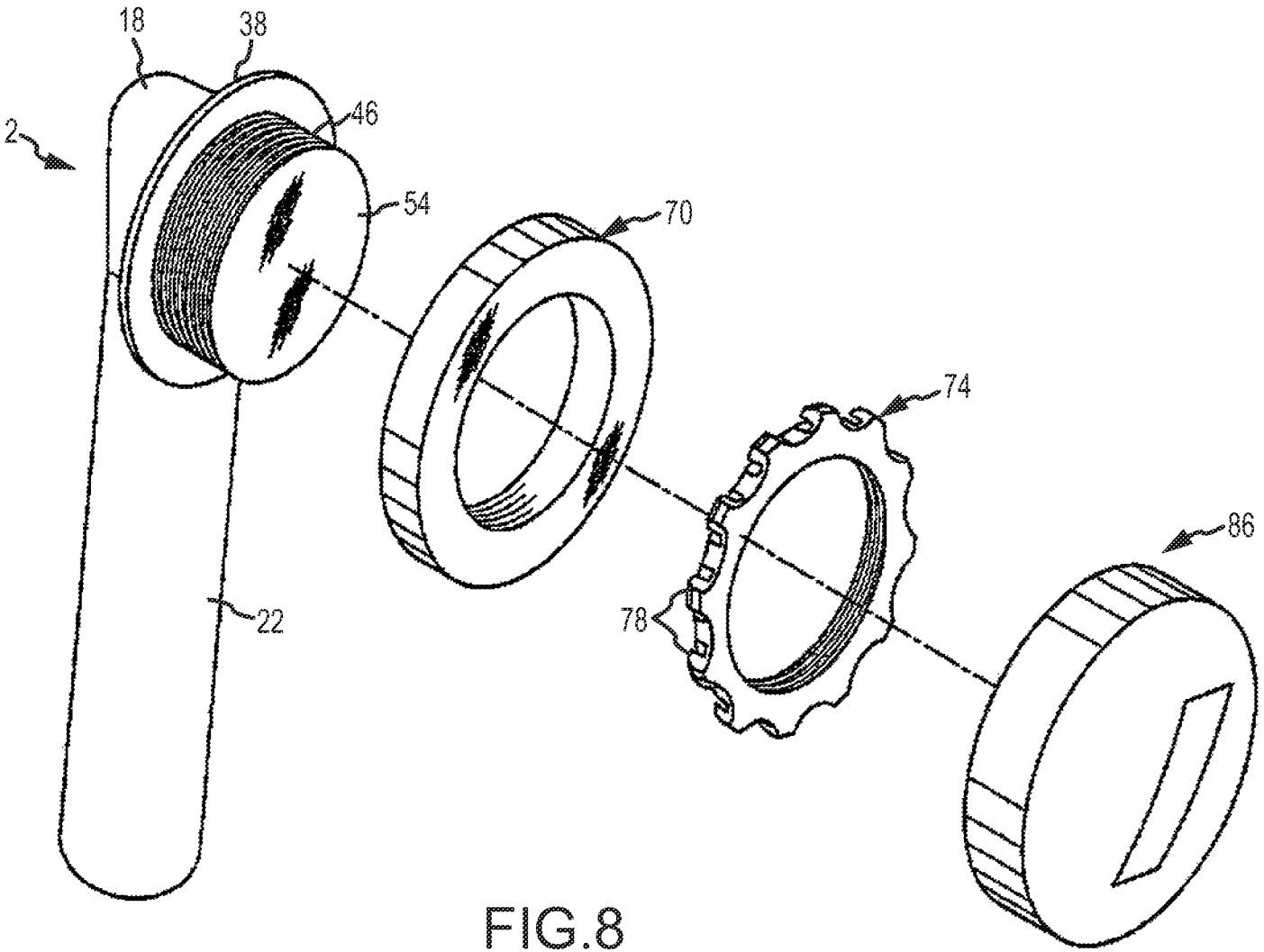
FIG. 8 is an exploded view of an alternate embodiment of an overflow assembly that employs a one-piece overflow pipe and cylindrical fitting.
Figure 9:
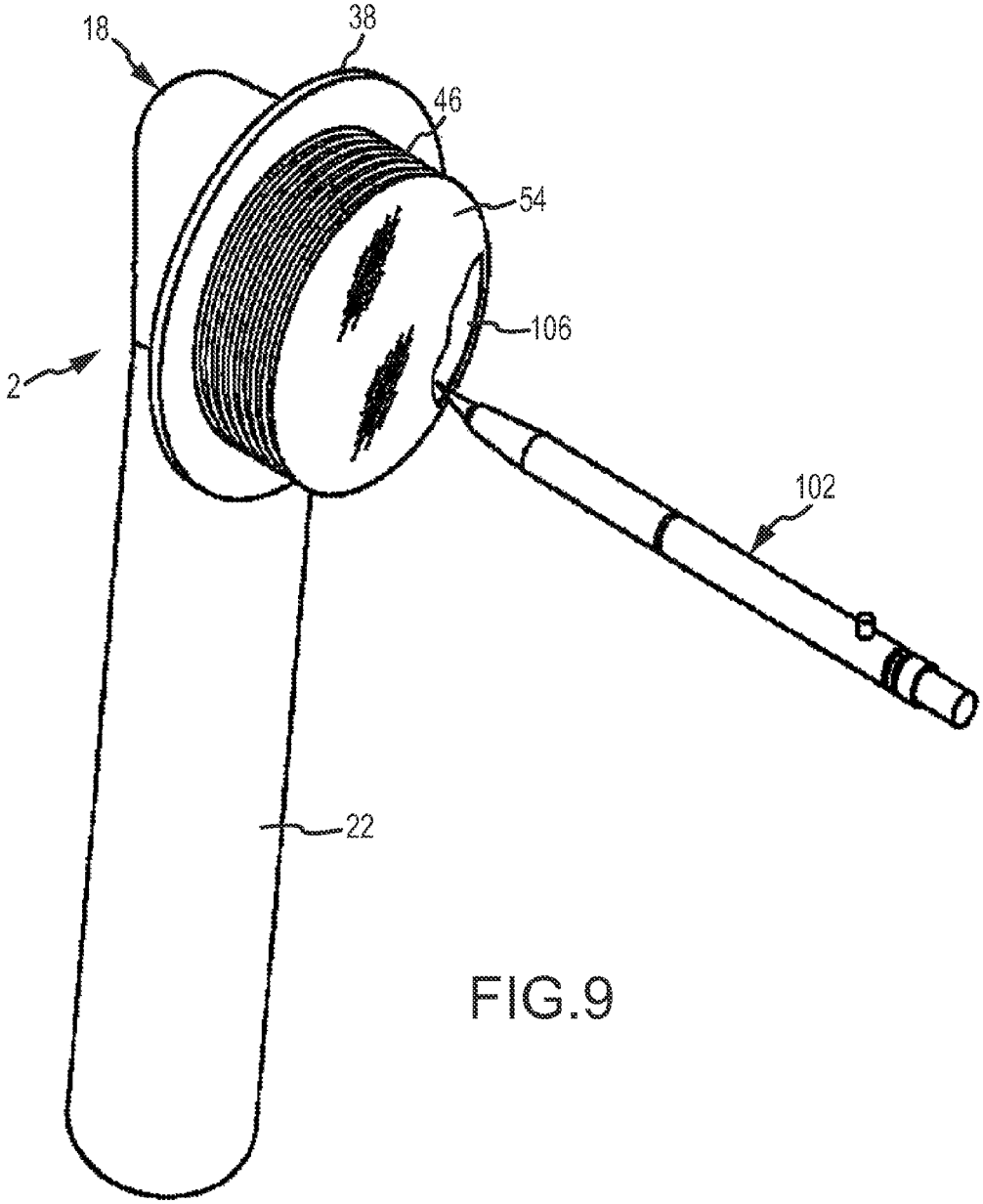
FIG. 9 is a perspective view of the one-piece overflow pipe and cylindrical fitting shown in FIG. 8.

Referring now to FIGS. 8 and 9, yet another variation of the above-identified overflow assembly is provided. Here, a one-piece unit is provided wherein the cylindrical fitting 46 and the elbow 18 are rigidly interconnected. In addition, one skilled in the art will appreciate that at least a portion of the overflow pipe 22 may also be rigidly interconnected to the elbow 18. This configuration omits at least two joints in the system, which reduces the likelihood of leaks between components. One skilled in the art will also appreciate that a diaphragm may also be included in this embodiment of the present invention that is cut away to provide an opening 106 after testing is performed.

Figure 10:
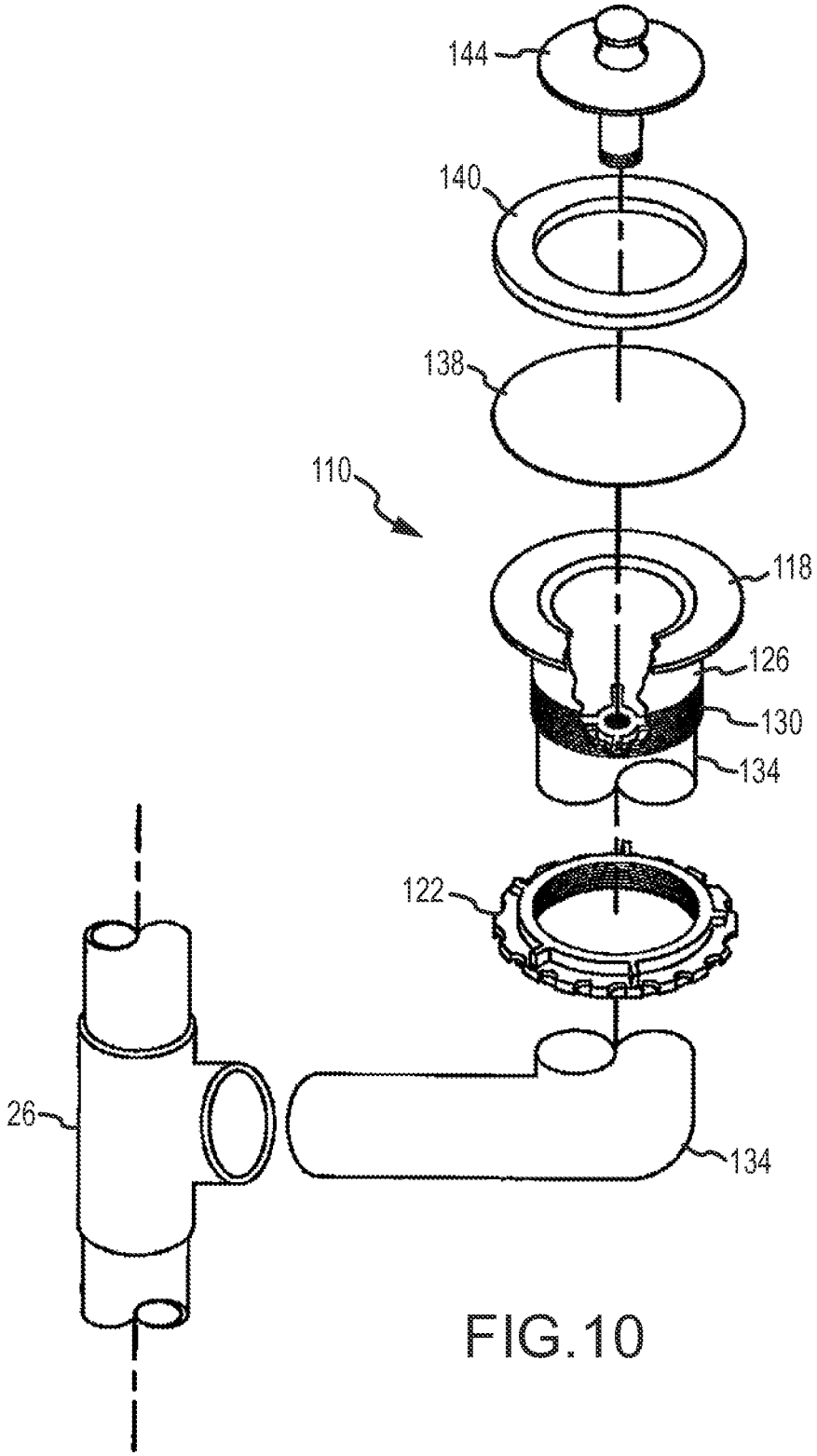
FIG. 10 is an exploded perspective view of a drain assembly of one embodiment of the present invention.
Figure 11:
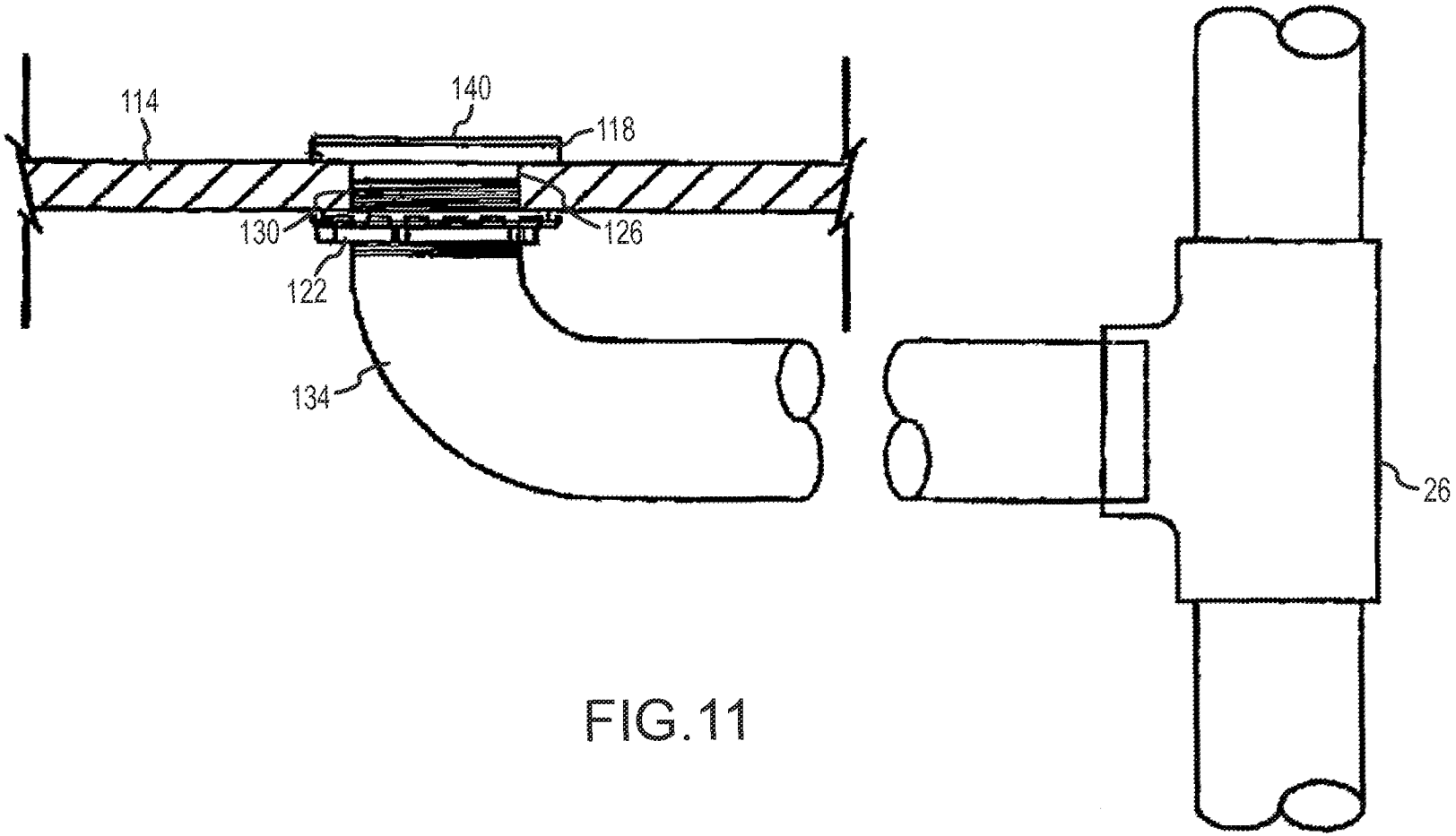
FIG. 11 is a side elevation view of the drain assembly shown in FIG. 10 interconnected to the bathtub.

Referring now to FIGS. 10 and 11, the drain assembly 110 for interconnecting the bathtub to the plumbing system of one embodiment of the present invention is shown. Here, similar to the overflow assembly, the drain assembly must be rigidly interconnected to the bathtub 6. Thus embodiments of the present invention employ a drain assembly 110 wherein the tub floor 114 is sandwiched between a drain pipe flange 118 and a nut 122. In operation, the drain pipe flange 118 includes a cylindrical portion 126 extending therefrom that includes a plurality of threads 130. The drain pipe flange 118 is mated with a drain pipe 134 wherein the nut 122 is threaded on the drain pipe 134 prior to the marriage of the cylindrical portion 126 and the drain pipe 134. The nut 122 is brought up to the threads 130 and tightened such that the tub floor is sandwiched between the drain pipe flange 118 and the nut 122 to secure the drain assembly to the drain port 10 of the bathtub 6. To test the system a membrane 138 may be employed to block flow to the drain pipe 134. After testing is completed, a cover 140 and drain closure 144, which are common in the art, may be incorporated.

Figure 12:
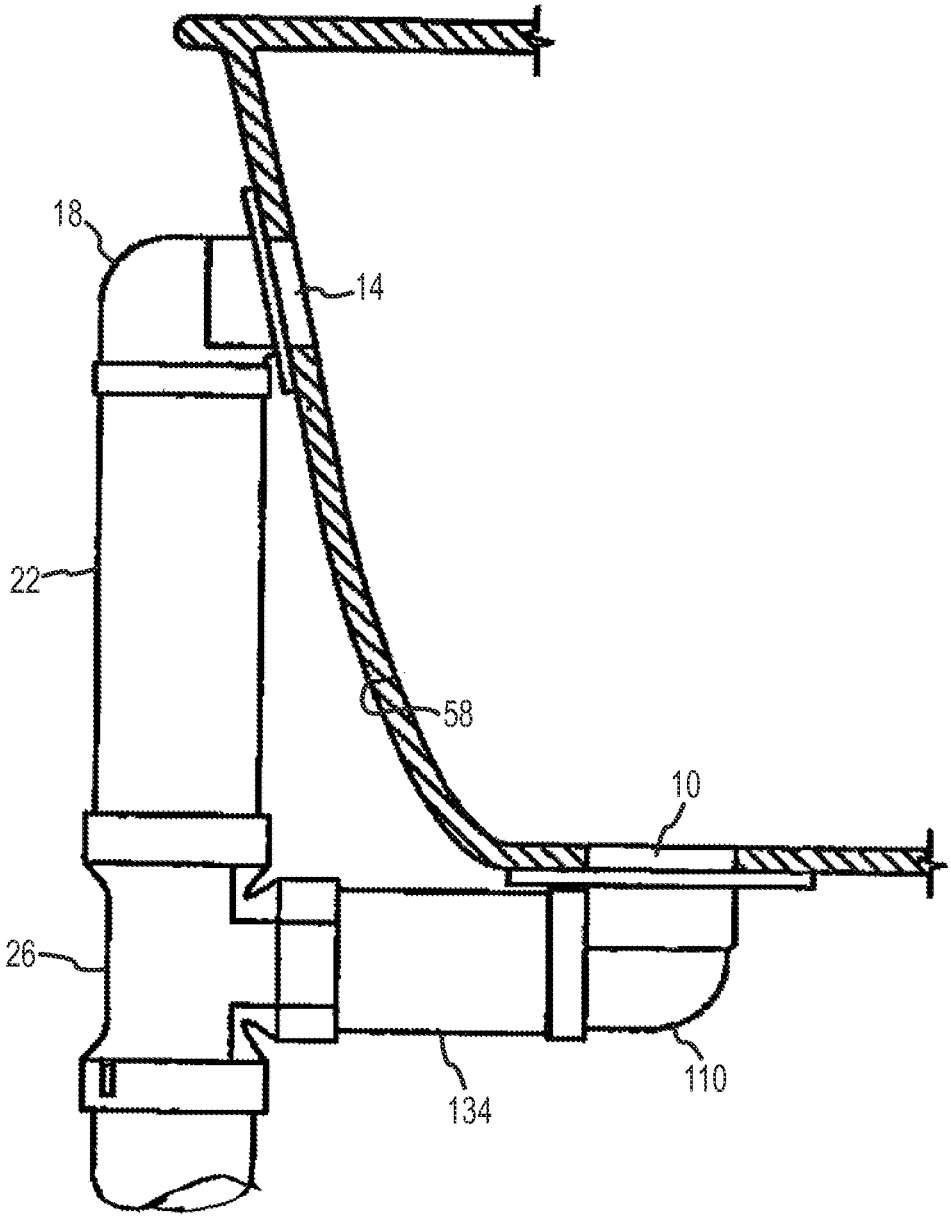
FIG.12 (PRIOR ART)
FIG. 12 is a side elevation view of a prior art interconnection horizontal and vertical drain pipes.

Referring now to FIGS. 12-15, a method of facilitating interconnection of the overflow pipe 22 and the drain pipe 134 is provided. FIG. 12 shows the prior art method of interconnecting drain pipes and flow pipes to a bathtub 6 wherein the rigid overflow pipe 22 is interconnected to the elbow 18 of the overflow assembly 2 and a rigid drain pipe 134 is horizontally interconnected from a connector associated with the drain port 10. These two rigid pipes merge at a tee-connector 26 and into the main drain pipe of the plumbing system. As one skilled in the art will appreciate, interconnection of these rigid pipes is often difficult, especially when they are misaligned due to engineering errors or errors in interconnecting of the individual pipes to the tee-connectors 26, for example. Often, the interconnection of the bathtub to the overflow pipe 22 and drain pipe 134 will cause frustration, delays and increased costs.

Figure 13:
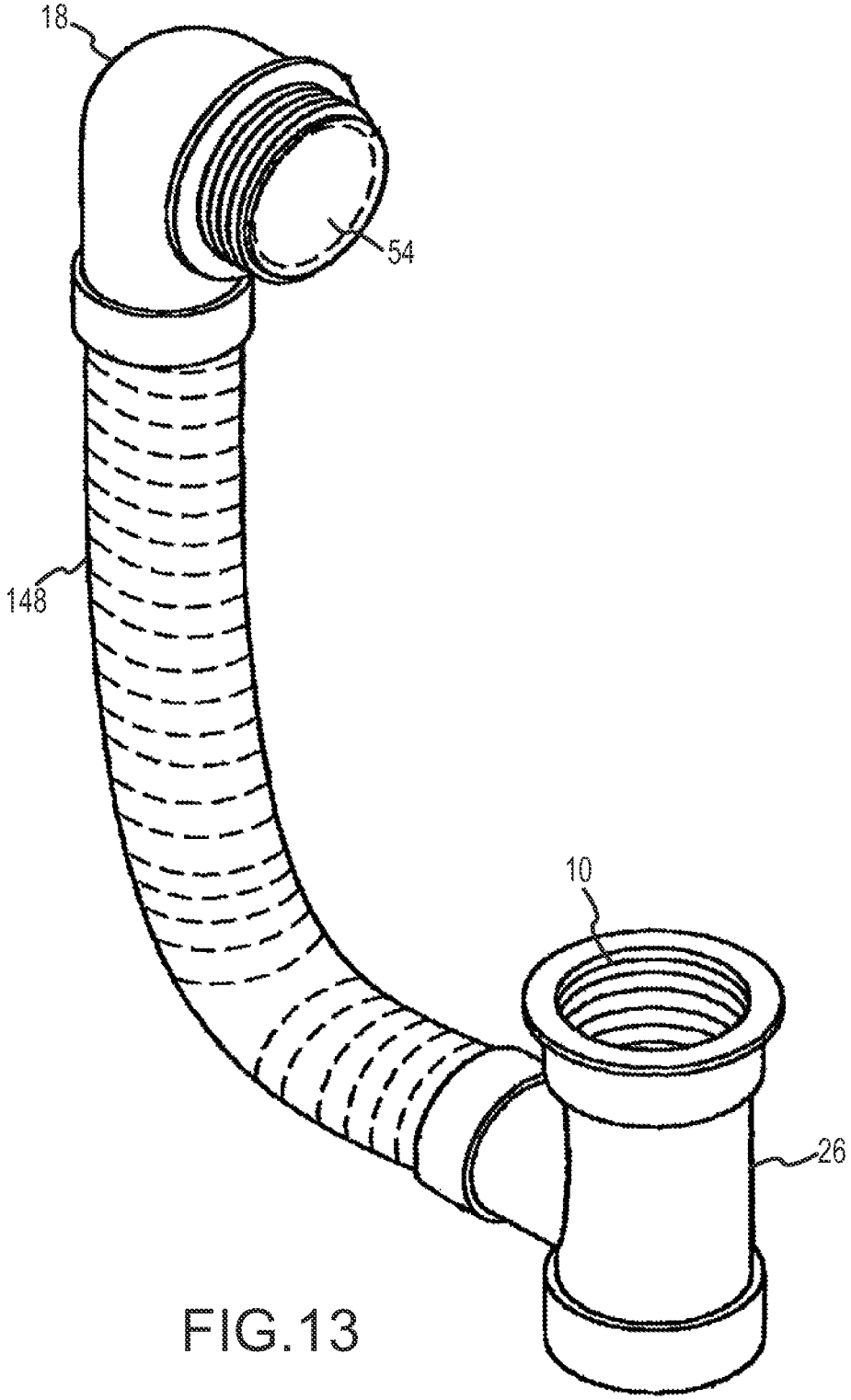
FIG. 13 is a perspective view of a flexible overflow pipe.
Figure 14:
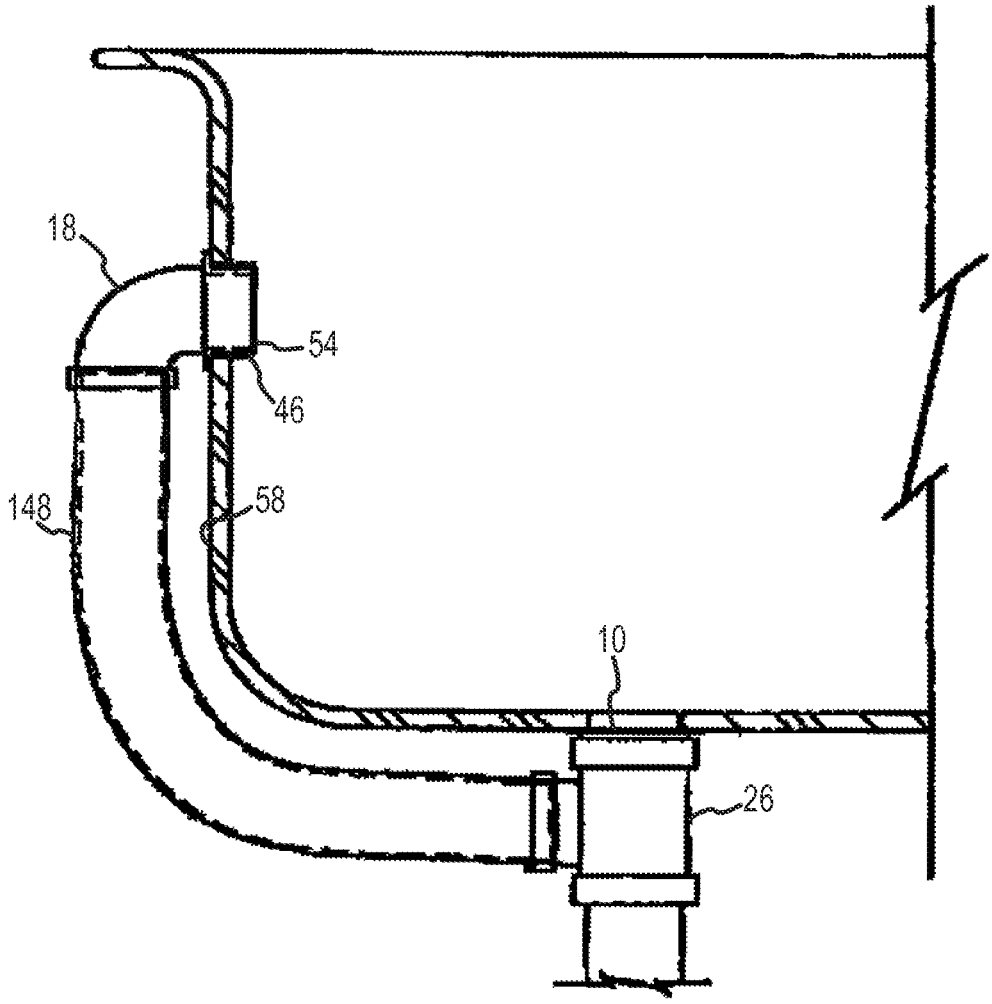
FIG. 14 is a side elevation view of the flexible conduit of FIG. 13 interconnected to the bathtub.

Referring now to FIGS. 13 and 14, this problem has been addressed by an embodiment of the present invention that provides a flexible conduit 148 that leads from the elbow 18 of the overflow assembly 2 to the tee-connector 26. It is envisioned that the flexible conduit 148 of this embodiment of the present invention be corrugated, however, be not susceptible to the drawbacks of using a corrugated tube. More specifically, as one skilled in the art will appreciate, the use of corrugated tubing, to allow for selective adjustments of tube bends is common. However, the use of a corrugated surface is not desirable and is often counter building codes since waste and fluid can gather in the corrugations provided in the inner diameter of the conduit thereby providing a breeding ground for a mold and germs. Thus the flexible conduit 148 of embodiments of the present invention employ a coating that maintains flexibility but yet eliminates at least the corrugations in the inner surface of the flexible conduit 148.

Figure 15:
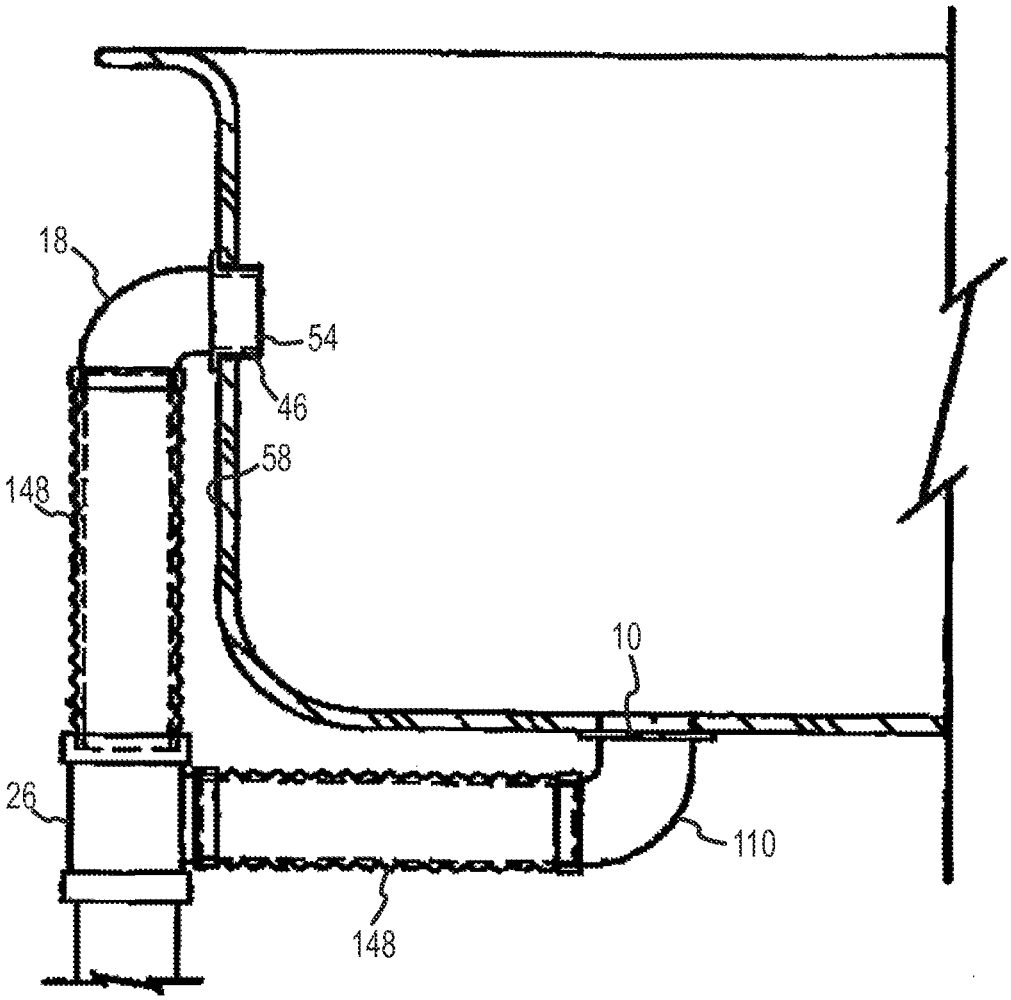
FIG. 15 is a side elevation of horizontal and vertical flexible conduits interconnected to the bathtub.
Figure 16:
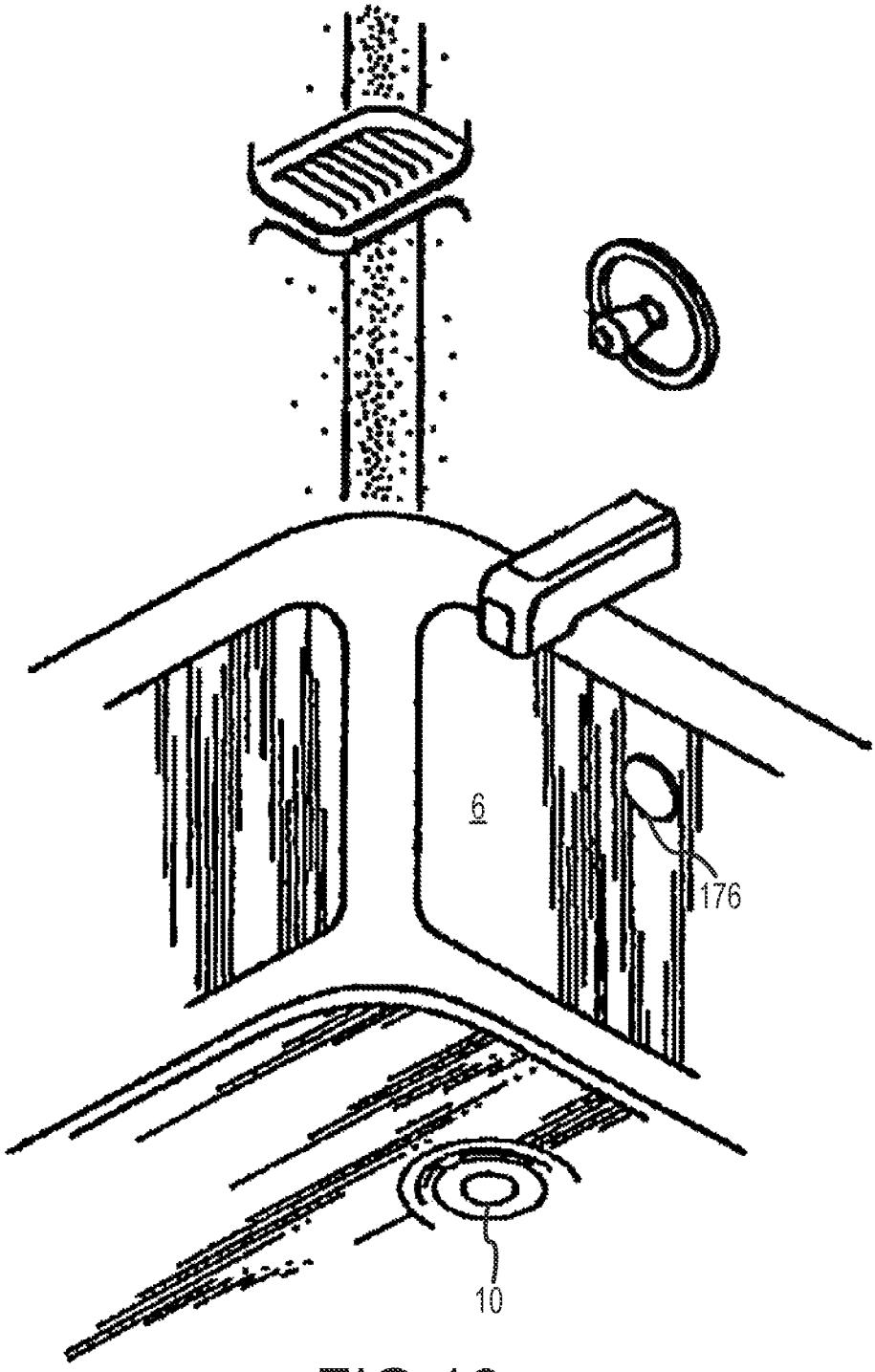
FIG. 16 is a partial perspective view of a bathtub showing a test cap interconnected to the overflow port.

Referring now specifically to FIG. 15, the flexible conduit 148 as described above may be employed in another way. That is, FIG. 14 shows the flexible conduit 148 extending from the overflow assembly 2 into the tee-connector 26 that is associated directly with the drain port 10. More often, it is desirable to provide a vertical overflow pipe 22 and a horizontal drain pipe 134. These pipes may be made of the flexible conduit as described above and interconnected as traditionally done to the tee-connector 26 that is associated with the main drain pipe of the plumbing system. Since the flexible conduit 148 as provided is pliable, it is easily cut. Thus plumbers may use the flexible conduit 148 as they would use rigid conduit and selectively cut them to lengths to interconnect to traditionally located tee-connectors 26.

Referring now to FIGS. 16-23, a test cap 176 of one embodiment of the present invention is provided. As mentioned above, it is often desirous to plug the overflow port 14 and/or drain port 10 of the bathtub to facilitate testing. As also described above, this is most preferably done with a diaphragm that omits the need for a test cap 176. However, if testing needs to be performed subsequent to removal of a diaphragm, a test cap 176 can be used.

Figure 17:
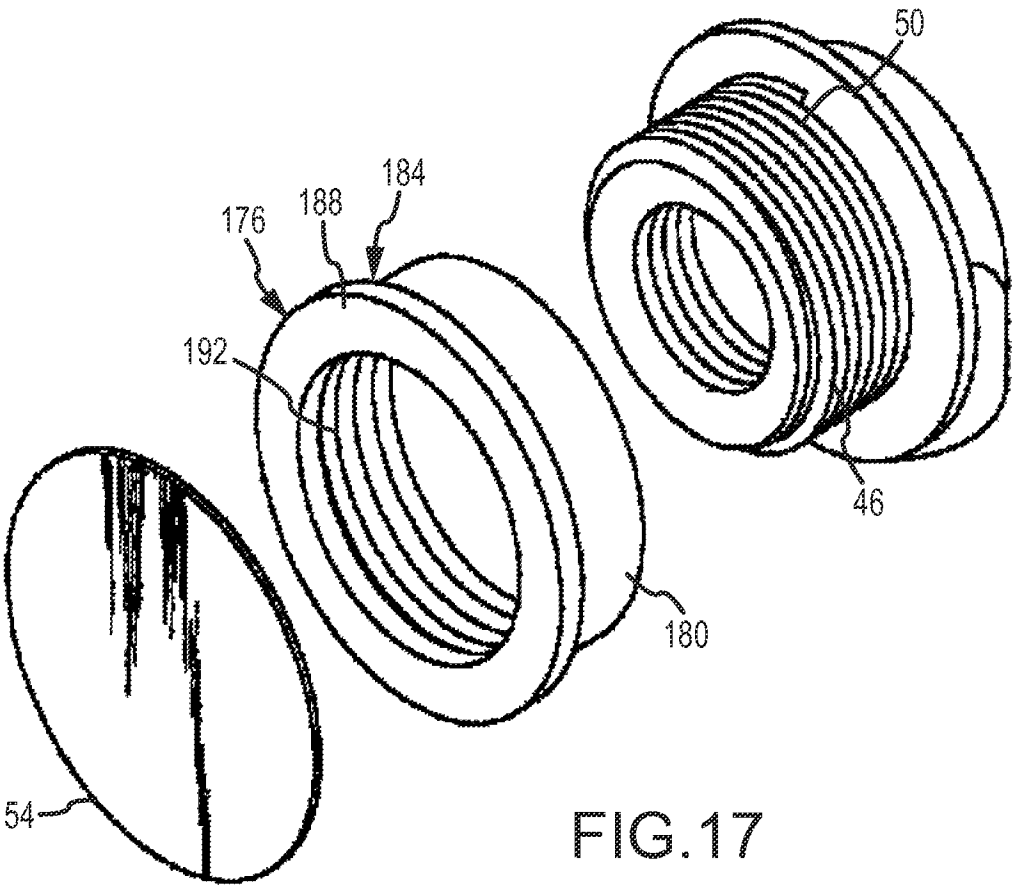
FIG. 17 is a perspective view of a test cap of one embodiment of the present invention.
Figure 18:
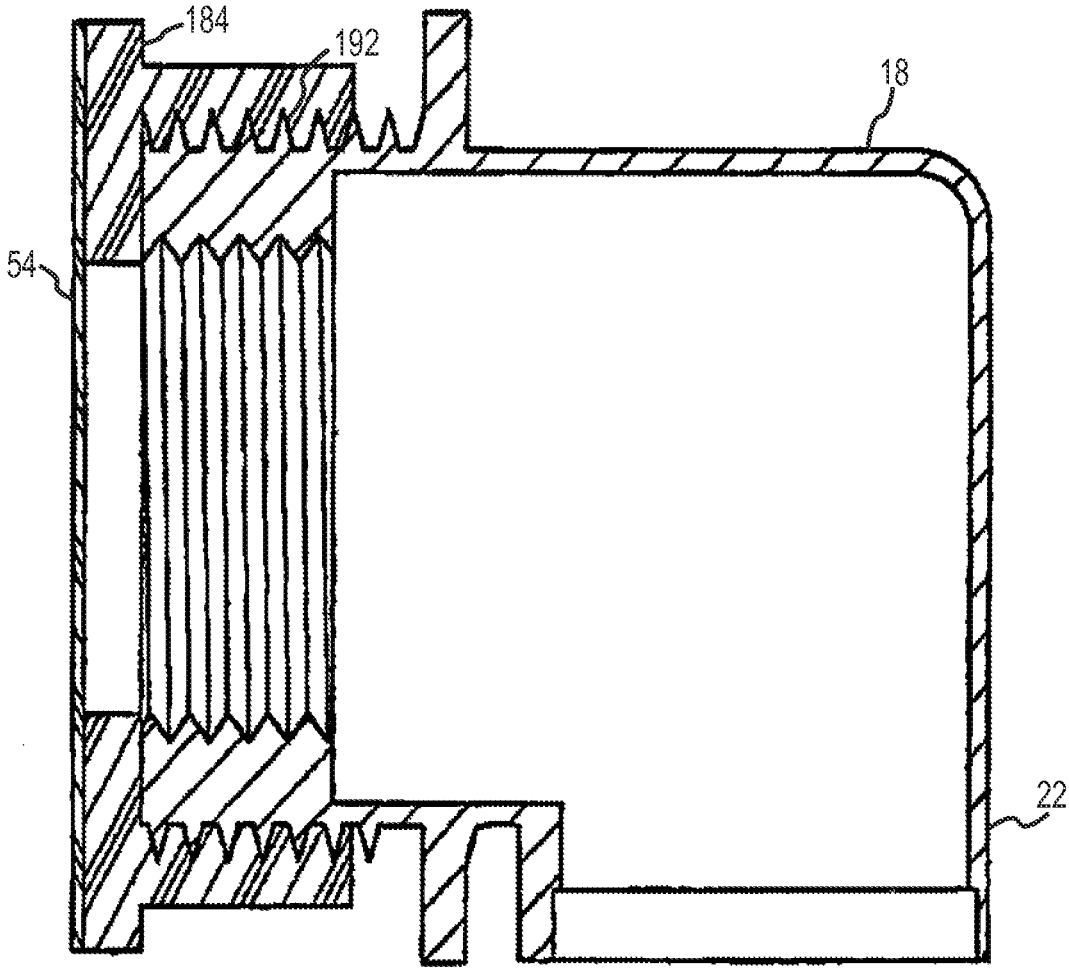
FIG. 18 is a cross-sectional view of the test cap of FIG. 17 interconnected to an overflow pipe.

Referring now to FIGS. 17 and 18, a test cap 176 of one embodiment of the present invention is provided with a cylindrical body 180 having a flange 184 positioned thereon. The flange 184 has a face 188 that receives a diaphragm 54 and includes internally located threads 192 that receive the threads of the cylindrical fitting 42 of the overflow assembly 2, similar to that described above. The test cap 176 of this nature can be used on overflow assemblies as described above that include a diaphragm 54 if further testing is required. After testing is completed, the diaphragm 54 of the test cap 176 of this embodiment of the present invention may be cut away to provide an opening 106 as described above.

Figure 19:
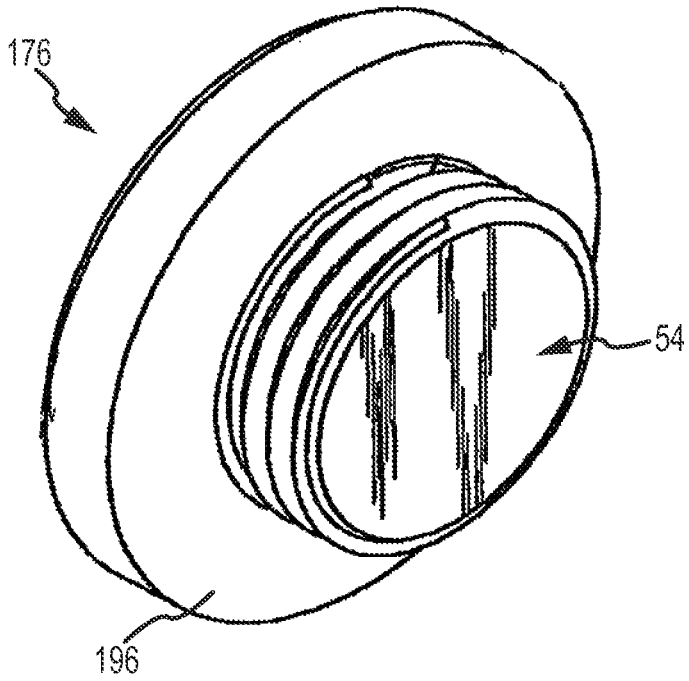
FIG. 19 is a perspective view of an alternative embodiment of a test cap.
Figure 20:
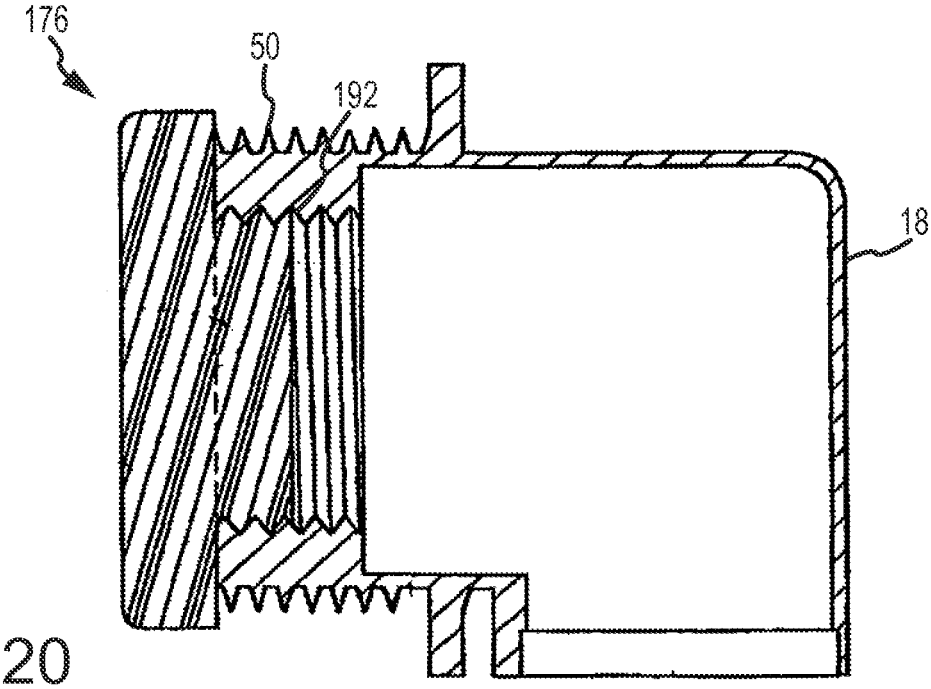
FIG. 20 is a cross-sectional view of the test cap of FIG. 19 shown interconnected to an overflow pipe.

Referring now to FIGS. 19 and 20 a test cap 176 of one embodiment of the present invention is shown. Here, a traditional plug having threads is used. However, this embodiment of the present invention also includes a diaphragm 54 positioned on one end that may be cut-away after testing is complete.

Figure 21:
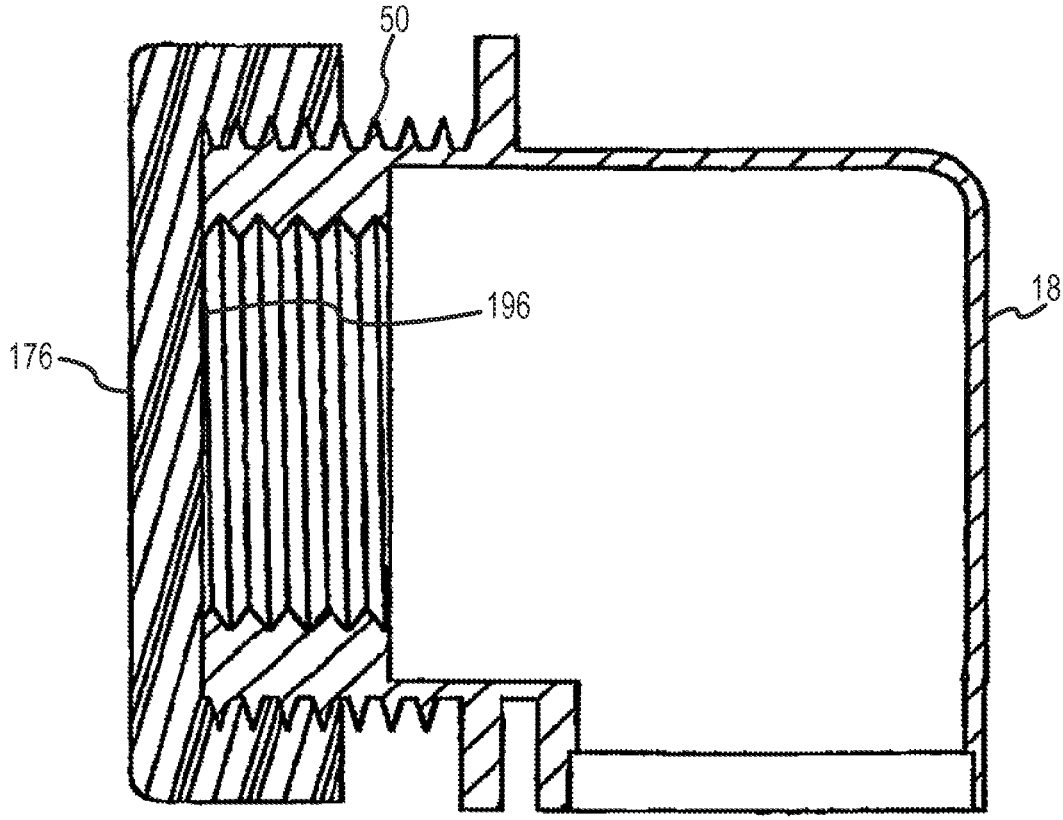
FIG. 21 is a side elevation view of an alternative embodiment of the test cap interconnected to an overflow pipe.
Figure 22:
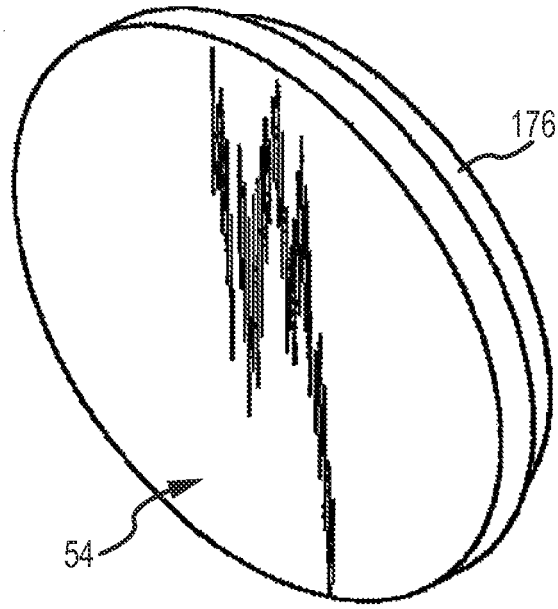
FIG. 22 is a front elevation view of another embodiment of the test cap having a removable diaphragm.
Figure 23:
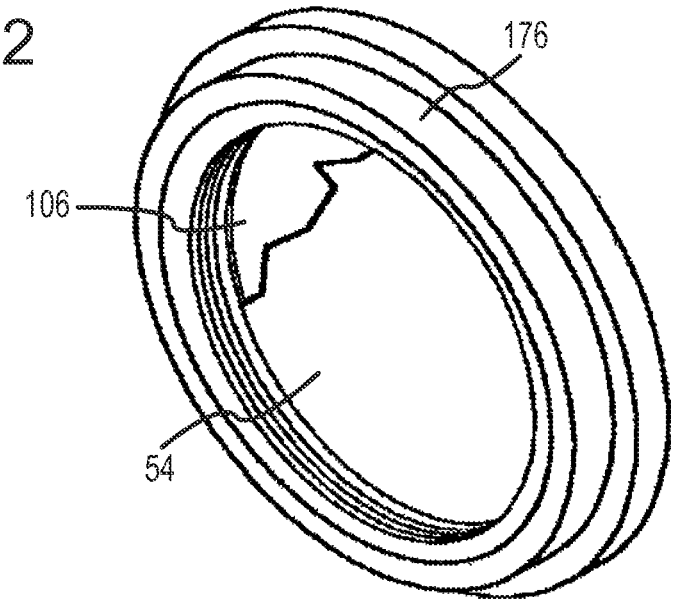
FIG. 23 is a rear perspective view of the test cap shown in FIG. 22.

Referring now to FIGS. 21-23, yet another version of the test cap 176 is provided with an inner surface 196 of malleable material that helps seal the interconnection of the test cap 176 and the overflow elbow 18. That is, by interconnecting the test cap 176 onto the external threads of the overflow elbow 18, the end of the overflow assembly 2 will deform the inner surface of the test cap 176 somewhat to create a seal. It is also envisioned that a test cap 176 of this embodiment of the present invention employs a diaphragm 54 that can be cut away if needed.

Figure 24:
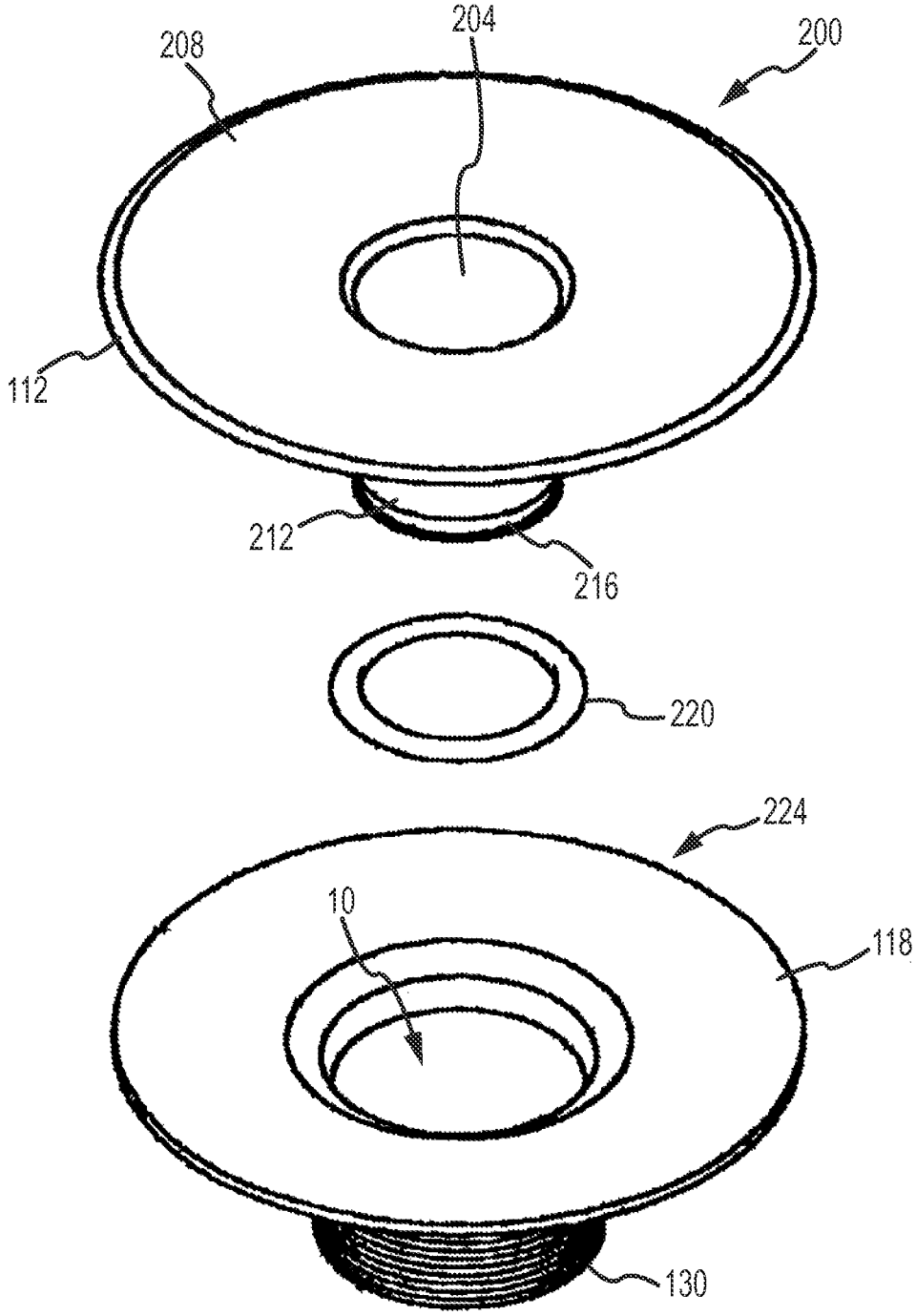
FIG. 24 is a perspective view of a protective cover and drain.
Figure 25:
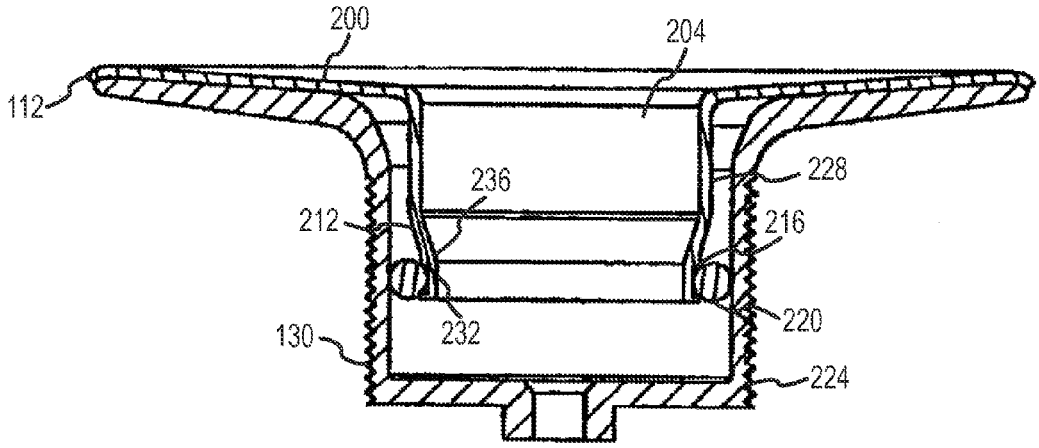
FIG. 25 is a cross-sectional view of the protective cover shown in FIG. 23.
Figure 26:
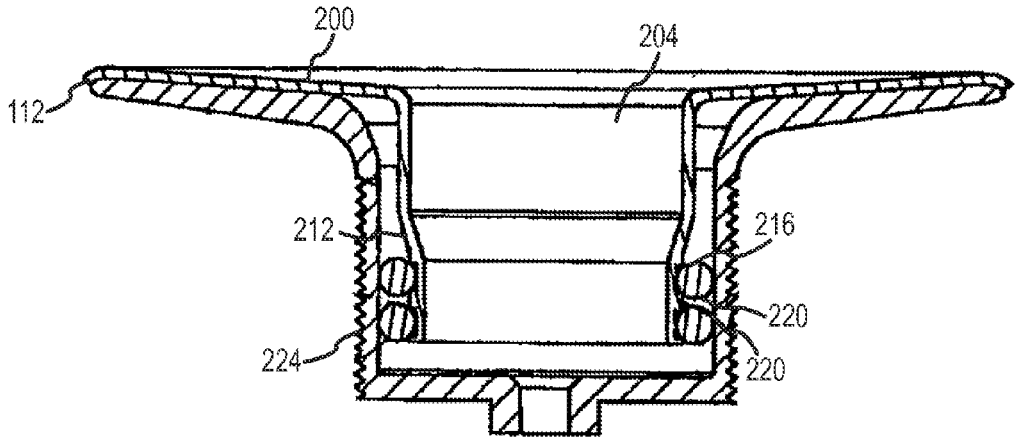
FIG. 26 is a cross-sectional view of an alternate embodiment of the protective cover.

Referring now to FIGS. 24-26, a protective drain cover 200 is provided. Here, the protective cover 200 having an opening 204 therethrough and a flange 208 is shown. Emanating from the flange 208 is the tubular wall 212 having a groove 216 positioned therearound. The groove 216 is adapted to receive at least one seal 220. The protective cover 200 is adapted to be associated with a strainer 224 of the drain assembly, thereby positioning the flange 208 of the protective cover 200 over the flange 118 of the strainer 224. In addition, the protective cover 200 includes an edge 112 that slightly curves downwardly to protect an edge of the strainer 224. As described above, the strainers 224 are often made of a brass or chrome which is easily damaged. Thus in operation, the tubular wall 212 of the drain cover 200 feeds into an opening of the strainer 224. The seals 220 are then disposed between the outer surface of the tubular wall 212 and the inner surface of the strainer 224. Thus the drain assembly 110 is protected during construction. After construction is completed, the protective cover 200 is removed and the drain assembly 110 remains within the bathtub 6.

As disclosed in U.S. Pat. No. 7,503,083, numeral 200 may also be viewed as a waste water insert. Insert 200 has a flange 208 with the periphery thereof terminating in a downwardly extending lip 112. As shown in FIGS. 25 and 26, the lip 112 extends downwardly and over the outer perimeter of the strainer flange 118. The lip 112 engages the tub floor 114 (see FIG. 11) when installed.

Insert 200 has a downwardly extending wall 212 which surrounds a center opening 204. The diameter of wall 212 is less than the diameter of the cylindrical wall of strainer 224 so that a space exists between the two walls. The lip 112 on the outer perimeter of the flange 208 of insert 200 centers the cylindrical wall 212 within the cylindrical wall of strainer. In one embodiment, the waste water insert 200 includes a wall 212 with a cylindrical first portion 228 and a cylindrical second portion 232 with a conical portion 236 therebetween. The diameter of the cylindrical first portion 228 is greater than the diameter of the cylindrical second portion 232 such that the space between the insert and the strainer is reduced adjacent to the cylindrical first portion 228.

The wall 212 extends downwardly and has a first groove 216 in the lower end. The groove 216 receives a resilient ring member 220 that engages the cylindrical wall 212 of the strainer 224 to hold the insert 200 in place. In one embodiment, the resilient ring member 220 is an O-ring. Alternatively, the waste water insert 200, as shown in FIG. 26, has a second groove in spaced relation to the first groove 216 with a raised surface therebetween. The second groove receives a second resilient ring member 220 that also engages the cylindrical wall 212 of strainer 200. Additional grooves and rings may be added as desired.

The insert is installed by inserting the cylindrical wall 212 of the insert 200 into the opening 10 of the strainer 224 until the insert is in place. At this point the resilient ring or rings of the insert will engage the cylindrical wall of the strainer 224 to hold the insert 200 in place. No tools are required and the inserts are quickly, easily, and securely installed to achieve their required purpose.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims.

What is claimed is:

1. A plumbing system for interconnection with a bathtub that has an overflow port and a drain port, comprising:

an overflow assembly for interconnection with the overflow port, said overflow assembly comprising:

an overflow pipe having a flange, said overflow port adapted to be associated with a threaded portion extending from said flange, said threaded portion adapted to pass through a wall of the bathtub and to be at least partially positioned within the bathtub;

a means for preventing fluid flow through said overflow pipe that is associated with said threaded portion, said means for preventing fluid flow sealing an outer end of said threaded portion;

a nut, having a threaded center opening, threadably mounted on said threaded portion of said overflow port, said nut being adapted to secure said flange to the wall of the bathtub by exerting pressure towards said flange; and said nut having an outer periphery with a series of radially extending cap retention elements which detachably engage an inner surface of a cap which fits over said nut; and a wastewater drain assembly for interconnection to the drain port.

2. The assembly of claim 1, wherein said means for preventing fluid flow is a selectively removable thin diaphragm.

3. The assembly of claim 1, wherein said means for preventing fluid flow is associated directly with said overflow pipe and does not extend into said threaded portion of said overflow port.

4. The assembly of claim 1, wherein said nut and said radially extending cap retention elements constitute a single-piece unit.

5. The assembly of claim 1, wherein said means for preventing fluid flow has a circular shape.

6. The assembly of claim 1, wherein said means for preventing fluid flow has a diameter that is not less than the diameter of said threaded portion of said overflow port.

7. The assembly of claim 1, wherein said means for preventing fluid flow comprises a plastic material.

8. The assembly of claim 1, wherein said means for preventing fluid flow is removable.

9. The assembly of claim 1, wherein said means for preventing fluid flow is circular, has a diameter that is not less than the diameter of said outer end of said outlet port, is composed of a plastic material, and is removable.

10. The assembly of claim 1, wherein said preventing fluid flow comprises a member that is at least one of circular, has a diameter that is not less than the diameter of said outer end of said outlet port, is composed of a plastic material, and is removable.

11. A plumbing system for interconnection with a bathtub that has an overflow port and a drain port, comprising:

an overflow assembly adapted for interconnection to a bathtub, which has a bottom, side walls, end walls, and the overflow port in one end wall, comprising:

an overflow pipe with an elbow portion defining an upper end portion and a lower end portion, said upper end portion having an outer end defining an inlet, said upper end having threads on an outer surface thereof;

a lip extending radially outwardly from said outer surface of the overflow pipe between said elbow portion and said upper end portion and being spaced from said inlet;

a device for affixing said overflow assembly to the bathtub sidewall having an internal, circular threaded surface, a nut body and radially extending cap retention elements, said circular threaded surface being compatible with said threads of said overflow pipe, said radially extending cap retention elements adapted to engage an inner surface of a cap that fits over said device for affixing said overflow assembly to the bathtub sidewall; and a wastewater drain assembly for interconnection to the drain port.

12. A plumbing system for interconnection with a bathtub that has an overflow port and a drain port, comprising:

an overflow assembly for a bathtub, comprising:

an overflow pipe having a flange, the overflow port adapted to be associated with a threaded portion extending from said flange, said threaded portion adapted to pass through a wall of the bathtub and to be at least partially positioned within the bathtub;

a device for affixing said overflow assembly to the bathtub wall having an internal, circular threaded surface, a nut body and radially extending cap retention elements, said circular threaded surface being threadably mounted on said threaded portion of said overflow port, said device for affixing said overflow assembly to the bathtub sidewall being adapted to secure said flange to the wall of the bathtub by exerting pressure towards said flange; and said radially extending cap retention elements which are adapted to engage an inner surface of a cap which fits over said device for affixing said overflow assembly to the bathtub wall; and a wastewater drain assembly for interconnection to the drain port.

13. A plumbing system for interconnection with a bathtub that has an overflow port and a drain port, the plumbing system also associated with a waste water strainer, said strainer having a cylindrical wall with a bottom edge surrounding a cylindrical opening extending through the bottom of the bathtub, and a flange extending outwardly from a level above and adjacent said cylindrical opening and positioned on the bottom of the bathtub, comprising:

an overflow assembly for a bathtub, comprising:

an overflow pipe having a flange, said overflow port adapted to be associated with a threaded portion extending from said flange, said threaded portion adapted to pass through a wall of the bathtub and to be at least partially positioned within the bathtub;

a device for affixing said overflow assembly to the bathtub wall having an internal, circular threaded surface, a nut body and radially extending cap retention elements, said circular threaded surface being threadably mounted on said threaded portion of said overflow pipe, said device for affixing said overflow assembly to the bathtub wall being adapted to secure said flange to the wall of the bathtub by exerting pressure towards said flange, and said radially extending cap retention elements being adapted to engage an inner surface of a cap which fits over said device for affixing said overflow assembly to the bathtub wall; and a waste water insert adapted for insertion within the wastewater strainer and comprising a wall with a cylindrical portion having an upper end with a flange extending outwardly from said cylindrical portion, said flange having a downwardly-extending lip associated with the outer edge thereof, said lip adapted to engage an outer edge of the flange of the wastewater strainer, and wherein.

* * * * *

UNITED STATES PATENT AND TRADEMARK OFFICE

CERTIFICATE OF CORRECTION

PATENT NO. : 8,584,272 B2
APPLICATION NO. : 13/691405
DATED : November 19, 2013
INVENTOR(S) : William T. Ball It is certified that error appears in the above-identified patent and that said Letters Patent is hereby corrected as shown below:

In the Claims

Column 9, line 37, replace "said overflow port" with -- said overflow pipe --

Column 9, lines 47-48, replace "said overflow port, said nut" with -- said overflow pipe, said nut --

Column 9, lines 61-62, replace "of said overflow port." with -- of said overflow pipe. --

Column 9, lines 63-64, replace "said radially extending" with -- said series of radially extending --

Column 10, line 3, replace "said overflow port." with -- said overflow pipe. --

Column 10, line 10, replace "said outer end of said outlet port," with -- said outer end of said overflow pipe, --

Column 10, lines 12-14, replace "said preventing fluid flow comprises a member that is at least one of circular, has a diameter that is" with -- said means for preventing fluid flow comprises a circular member, a diameter that is --

Column 10, line 15, replace "said outlet port," with -- said overflow pipe, --

Column 10, lines 19-20, replace "a bathtub" with -- the bathtub --

Column 10, line 25, replace "end having" with -- end portion having --

Column 10, lines 30-31, replace "to the bathtub sidewall" with -- to one bathtub sidewall --

Column 10, line 33, replace "said circular threaded" with -- said internal, circular threaded --

Column 10, lines 37-38, replace "the bathtub sidewall" with -- the one bathtub sidewall --

Column 10, line 43, replace "for a bathtub" with -- for the bathtub --

Signed and Sealed this
Fifteenth Day of April, 2014

Michelle K. Lee

Michelle K. Lee
*Deputy Director of the United States Patent and Trademark Office*

Column 10, line 44, replace “overflow port” with -- overflow pipe --

Column 10, line 52, replace “said circular threaded” with -- said internal, circular threaded --

Column 10, lines 53-54, replace “overflow port” with -- overflow pipe --

Column 11, line 5, replace “for a bathtub” with -- for the bathtub --

Column 11, line 6, replace “overflow port” with -- overflow pipe --

Column 11, lines 26-27, replace “said flange having” with -- said flange of the wastewater strainer having --

Column 11, line 27, replace “the outer” with -- an outer --

Column 11, line 28, replace “engage an outer” with -- engage said outer --

Column 11, lines 29-30, replace “strainer, and wherein.” with -- strainer. --